US011499564B2

(12) United States Patent
Van Houten et al.

(10) Patent No.: US 11,499,564 B2
(45) **Date of Patent: *Nov. 15, 2022**

(54) FREE-TIPPED AXIAL FAN ASSEMBLY

(71) Applicant: Robert Bosch GmbH, Stuttgart (DE)

(72) Inventors: Robert J. Van Houten, Winchester, MA (US); Yoonshik Shin, Chandler, AZ (US)

(73) Assignee: Robert Bosch GmbH, Stuttgart (DE)

( * ) Notice: Subject to any disclaimer, the term of this patent is extended or adjusted under 35 U.S.C. 154(b) by 235 days.

This patent is subject to a terminal disclaimer.

(21) Appl. No.: 17/101,482

(22) Filed: Nov. 23, 2020

(65) Prior Publication Data

US 2021/0095684 A1 Apr. 1, 2021

Related U.S. Application Data

(63) Continuation of application No. 15/563,842, filed as application No. PCT/US2016/027655 on Apr. 15, 2016, now Pat. No. 10,844,868.

(Continued)

(51) Int. Cl.
*F01D 5/20* (2006.01)
*F04D 29/16* (2006.01)

(Continued)

(52) U.S. Cl.
CPC ..... *F04D 29/164* (2013.01); *F04D 29/526* (2013.01); *F04D 29/681* (2013.01);

(Continued)

(58) Field of Classification Search
CPC .... F04D 29/164; F04D 29/526; F04D 29/681; F04D 29/685; F05D 2240/307;

(Continued)

(56) References Cited

U.S. PATENT DOCUMENTS 2,350,309 A * 5/1944 Dahlstrand ..... F01D 5/225 29/889.7
2,350,310 A * 5/1944 Dahlstrand ..... F01D 5/225 416/192

(Continued)

FOREIGN PATENT DOCUMENTS

CN 101535657 A 9/2009
CN 201606315 U 10/2010

(Continued)

OTHER PUBLICATIONS

Office Action from the Intellectual Property Office of the People's Republic of China for Application No. 201680021819.3 dated Dec. 5, 2018 (11 pages).

(Continued)

*Primary Examiner* — Hung Q Nguyen
*Assistant Examiner* — Anthony Donald Taylor, Jr.
(74) *Attorney, Agent, or Firm* — Michael Best & Friedrich LLP

(57) ABSTRACT

A free-tipped axial fan assembly features a shroud barrel comprising an inlet, the radius of said inlet at its upstream end being greater than the radius of said inlet at its downstream end. An angle, in a plane including the fan axis, between the surface of said inlet and the direction of the fan axis varies non-monotonically with respect to a surface coordinate which increases with distance along the surface of the inlet.

20 Claims, 17 Drawing Sheets

Related U.S. Application Data

(60) Provisional application No. 62/147,686, filed on Apr. 15, 2015.

(51) Int. Cl.
*F04D 29/52* (2006.01)
*F04D 29/68* (2006.01)

(52) U.S. Cl.
CPC ..... *F04D 29/685* (2013.01); *F05D 2240/307* (2013.01); *F05D 2250/181* (2013.01); *F05D 2250/182* (2013.01); *F05D 2250/183* (2013.01)

(58) Field of Classification Search
CPC ..... F05D 2250/181; F05D 2250/182; F05D 2250/183
USPC ..... 415/173.1, 220
See application file for complete search history.

(56) References Cited

U.S. PATENT DOCUMENTS

| | | | | |
|---|---|---|---|---|
| 3,173,605 | A | 3/1965 | Harris | |
| 4,566,852 | A | 1/1986 | Hauser | |
| 4,822,249 | A * | 4/1989 | Eckardt | F01D 5/145 416/235 |
| 5,244,347 | A | 9/1993 | Gallivan et al. | |
| 5,290,144 | A | 3/1994 | Kreitmeier | |
| 5,489,186 | A | 2/1996 | Yapp et al. | |
| 5,513,952 | A * | 5/1996 | Mizuta | F04D 21/00 415/220 |
| 5,518,364 | A * | 5/1996 | Neise | F04D 29/164 415/220 |
| 6,102,655 | A * | 8/2000 | Kreitmeier | F01D 11/08 415/173.5 |
| 6,338,609 | B1 * | 1/2002 | Decker | F04D 29/522 415/173.1 |
| 6,454,527 | B2 | 9/2002 | Nishiyama et al. | |
| 6,464,460 | B2 * | 10/2002 | El-Nashar | F01D 5/187 416/191 |
| 6,595,744 | B2 | 7/2003 | Van Houten | |
| 7,004,722 | B2 * | 2/2006 | Teramura | F01D 5/143 415/173.1 |
| 7,449,744 | B1 | 11/2008 | Yu et al. | |
| 7,476,086 | B2 * | 1/2009 | Wadia | F01D 5/141 416/223 R |
| 7,789,622 | B2 | 9/2010 | Acre | |
| 7,794,204 | B2 | 9/2010 | Stevens et al. | |
| 8,137,070 | B2 | 3/2012 | Van Houten | |
| 8,568,095 | B2 | 10/2013 | Bushnell | |
| 8,647,054 | B2 * | 2/2014 | Aulich | F01D 5/20 415/173.1 |
| 8,777,558 | B2 | 7/2014 | Brunet et al. | |
| 8,784,046 | B2 | 7/2014 | Kuwamura et al. | |
| 9,004,860 | B2 | 4/2015 | Van Houten | |
| 9,102,397 | B2 * | 8/2015 | Wood | B64C 11/18 |
| 9,695,695 | B2 * | 7/2017 | Pouzadoux | F01D 5/141 |
| 9,784,277 | B2 | 10/2017 | Scouarnec | |
| 2002/0076327 | A1 * | 6/2002 | Houten | F04D 29/582 416/189 |
| 2004/0028526 | A1 | 2/2004 | Teremura et al. | |
| 2005/0074333 | A1 | 4/2005 | Iwasaki et al. | |
| 2007/0147989 | A1 | 6/2007 | Collins | |
| 2010/0068028 | A1 * | 3/2010 | Bushnell | F04D 29/164 415/200 |
| 2011/0211949 | A1 * | 9/2011 | Van Houten | F04D 29/681 415/220 |
| 2011/0223024 | A1 * | 9/2011 | Van Houten | F04D 29/164 416/223 R |
| 2011/0229301 | A1 | 9/2011 | Miller | |
| 2012/0024974 | A1 | 2/2012 | Grodsky et al. | |
| 2012/0076634 | A1 * | 3/2012 | Valliappan | F01D 5/225 415/173.1 |
| 2013/0251534 | A1 | 9/2013 | Matsumoto et al. | |
| 2014/0154061 | A1 | 6/2014 | Kuwamura et al. | |
| 2014/0271172 | A1 * | 9/2014 | Van Houten | F04D 29/681 415/211.1 |
| 2015/0071776 | A1 * | 3/2015 | Scouarnec | F04D 19/002 415/208.2 |

FOREIGN PATENT DOCUMENTS

| | | | | |
|---|---|---|---|---|
| CN | 102947597 | A | 2/2013 | |
| CN | 104302925 | A | 1/2015 | |
| DE | 102012224485 | A1 * | 7/2014 | F04D 19/002 |
| DE | 102012224485 | A1 | 7/2014 | |
| FR | 2753495 | A1 * | 3/1998 | F04D 29/164 |
| FR | 2753495 | A1 | 3/1998 | |
| JP | 2015038338 | A * | 2/2015 | F04D 29/32 |
| JP | 2015038338 | A | 2/2015 | |

OTHER PUBLICATIONS

International Search Report and Written Opinion for Application No. PCT/US2016/027655 dated Jun. 22, 2016 (12 pages).

Hah et al., "Aerodynamic Inner Working of Circumferential Grooves in a Transonic Axial Compressor", <https://ntrs.nasa/gov/archive/nasa/casi.ntrs.nasa.gov/20080005552.pdf>, 2007, 8 pages.

Notice of Preliminary Rejection from the Korean Intellectual Property Office for Application No. 10-2017-7029467 dated Oct. 31, 2018 (11 pages).

Notice of Reasons for Refusal from the Japanese Patent Office for Application No. 2017-554065 dated Oct. 1, 2018 (18 pages).

* cited by examiner

FREE-TIPPED AXIAL FAN ASSEMBLY

CROSS-REFERENCE TO RELATED APPLICATIONS

This application is a continuation of U.S. patent application Ser. No. 15/563,542, filed on Oct. 2, 2017, now U.S. Pat. No. 10,844,868 which is a § 371 national phase filing of International Patent Application PCT/US2016/027655, filed on Apr. 15, 2016, which claims the benefit of priority from U.S. Provisional Patent Application No. 62/147,686, filed on Apr. 15, 2015, the entire contents of all of which are incorporated by reference herein.

BACKGROUND

This invention relates generally to free-tipped axial-flow fans, which may be used as automotive engine-cooling fans, among other uses.

Engine-cooling fans are used in automotive vehicles to move air through a set of heat exchangers which typically includes a radiator to cool an internal combustion engine, an air-conditioner condenser, and perhaps additional heat exchangers. These fans are generally mounted in a shroud which directs air between the heat exchangers and the fan and controls recirculation. Typically, these fans are powered by an electric motor which is supported by the shroud.

The fans are typically injection-molded in plastic, a material with limited mechanical properties. Plastic fans exhibit creep deflection when subject to rotational and aerodynamic loading at high temperature. This deflection must be accounted for in the design process.

Although some engine-cooling fans have rotating tip hands connecting the tips of all the blades, many are free-tipped—i.e., the tips of the blades are free from connection with one another. Free-tipped fans have several advantages when compared to banded fans. They can have lower cost, reduced weight, better balance, and advantages due to their reduced inertia, such as lower couple imbalance, lower precession torque, and faster coast-down when depowered.

Often free-tipped fans are designed to have a constant-radius tip shape, and to operate in a shroud barrel which is cylindrical in the area of closest clearance with the fan blades. In other cases, the tip radius is non-constant. For example, U.S. Pat. No. 6,595,744 describes a free-tipped engine-cooling fan in which the blade tips are shaped to conform to a flared shroud barrel. This configuration reduces flow separation at the entrance to the barrel while allowing the blade tip to operate in close proximity to the shroud.

Free-tipped fans are designed have a tip gap, or running clearance, between the blade tips and the shroud barrel. This tip gap must be sufficient to allow for both manufacturing tolerances and the maximum deflection that may occur over the service life of the fan assembly. In practice, this gap is generally at least 0.5 percent, but less than 2 percent of the fan diameter, and more typically approximately 1 percent of fan diameter.

The presence of a tip gap has numerous adverse effects on performance. One effect is that as the gap increases the teen must operate at higher speeds to achieve a given operating point. This is due to the fact that the blade loading the pressure differential between the pressure and suction sides of the fan blade is reduced in the vicinity of the gap. Other effects are reduced fan efficiency and increased fan noise, particularly when the system resistance is high. These adverse effects can limit the applicability of free-tipped fans to applications where the system resistance is relatively low. In order to increase the applicability of free-tip fans, there have been a number of attempts to overcome the adverse performance effects caused by the tip gap.

One approach is to design the fan so as to counteract the effect of the tip gap on the fan loading. U.S. patent application Ser. No. 13/035,440, issued as U.S. Pat. No. 9,004,860, describes a fan with improved tip loading in the presence of a tip gap. This fan can improve fan performance, but the efficiency and noise of the fan are still compromised by the gap.

Other of have sought to reduce the deflection of the blade tip, so that the tip gap can be made smaller without risk of interference. U.S. Pat. No. 6,595,744 describes a rake distribution which can reduce the axial deflection of a skewed free-tip fan, and U.S. Pat. No. 8,137,070 describes a leading- and trailing-edge skew distribution which minimizes radial deflection.

Another approach is to design the tip of the fan in such a way that the flow of air through a given size gap is minimized. U.S. patent application Ser. No. 13/964,872, published as U.S. Patent Application Publication No. 2014/0271172, describes a fan with a locally thickened tip which demonstrates improved efficiency and reduced noise compared with a fan with a non-thickened tip section.

Although past efforts have improved the efficiency and reduced the noise of five-tip fans, there is still a need for quieter free-tip fan assemblies, particularly at high-pressure operating points. At these operating points, the tip vortex generated by each blade may interact with that blade, the shroud barrel, and/or the following blade. This interaction can cause a significant increase in the noise compared with the noise at a lower-pressure operating point.

SUMMARY

In one aspect, the present invention provides a free-tipped axial fan assembly comprising a fan and a shroud, the fan comprising a plurality of radially extending blades, each of the plurality of blades having a blade up, a leading edge, and a trailing edge, the fan having a diameter D equal to two times the radial extent of the blade tips at the trailing edge. The shroud comprises a barrel and the barrel comprises an inlet, the radius of the inlet at its upstream end being, greater than the radius of the inlet at its downstream end. The fan assembly is characterized in that, the angle, in a meridional plane, between the surface of the inlet and the direction of the fan axis varies non-monotonically with respect to a surface coordinate which increases with distance along the surface of the inlet from its upstream end to its downstream end.

In one aspect of the invention, the free-tipped axial fan is further characterized in that the radial coordinate of the inlet surface decreases or remains constant as the surface coordinate increases.

In another aspect of the invention, the live-tipped axial fan assembly is further characterized in that the axial coordinate of the inlet surface increases or remains approximately constant as the surface coordinate increases.

In another aspect of the invention, the free-tipped axial fan assembly is further characterized in that the inlet comprises steps, each step having an approximately axial (radial-facing in the meridional plane) surface, and an approximately radial (axial-facing in the meridional plane) surface.

In another aspect of the invention, the free-tipped axial fan assembly is further characterized in that an imaginary straight line, lying in a meridional plane, can touch the inlet surface at two points located along the region of non-monotonically varying angle without intersecting the surface between the points, and a distance between the imaginary line and a point on the barrel surface lying between said two points, measured normal to the imaginary line, is equal to or greater than 0.2 percent of the fan diameter.

In another aspect of the invention, the distance is equal to or greater than 0.4 percent of the fan diameter.

In another aspect of the invention, the tree tipped axial fan assembly is further characterized in that at least a portion of the inlet is located at the axial location of at least a portion of a blade tip, and the radial dimension of the inlet at the axial location of the upstream end of the portion is greater than the radial dimension of the inlet at the axial location of the downstream end of the portion, and the radial extent of the blade tip at the upstream end of the portion is greater than the radial extent of the blade tip at the downstream end of the portion, and the portion of the inlet located at the axial location of the portion of the blade tip includes at least a portion of the region of non-monotonically varying angle, the axial location of the portion of the region of non-monotonically varying angle defining a second portion of the blade tip.

In another aspect of the invention, the free-tipped axial fan assembly is further characterized in that an imaginary straight line, lying in a meridional plane, can touch the inlet surface at two points, both of which lie in the region of non-monotonically varying angle and within the axial extent of the blade tip, without intersecting the surface between the points, and a distance between the imaginary line and a point on the barrel surface lying between said two points, measured normal to the imaginary line, is equal to or greater than 0.2 percent of the fan diameter.

In another aspect of the invention, the free-tipped axial fan assembly is further characterized in that the distance is equal to or greater than 0.4 percent of the fan diameter.

In another aspect of the invention, the free-tipped axial fan assembly is further characterized in that the axial location of the entirety of the blade tip is within the axial extent of the inlet.

In another aspect of the invention, the free-tipped axial fan assembly is further characterized in that the region of non-monotonically varying angle extends at least over the upstream-most 50 percent of the axial extent of the portion of the inlet which overlaps with the axial extent of the blade tip.

In another aspect of the invention, the free-tipped axial fan assembly is further characterized in that the region of non-monotonically varying angle extends at least over the downstream-most 50 percent of the axial extent of the second portion of the inlet which is upstream of the blade tip.

In another aspect of the invention the free-tipped axial assembly is further characterized in that the radial dimension of the inlet at the upstream end of the portion is greater than the radial dimension of the inlet at the downstream end of the portion by at least 2 percent of the radial dimension of the inlet at the downstream end of the portion.

In another aspect of the invention, the free-tipped axial fan assembly is further characterized in that the radial extent of the blade tip at the upstream end of the portion is greater than the radial extent of the blade tip at the downstream end of the portion by at least 2 percent of the radial extent of the blade tip at the downstream end of the portion.

In another aspect of the invention, the free-tipped axial fan assembly is further characterized in that the swept extent of the blade tip portion conforms to the shape of said inlet portion.

In another aspect of the invention, the free-tipped axial fan assembly is further characterized in that the minimum distance between the portion of the blade tip and the portion of the inlet, measured perpendicular to the swept extent of the blade tip, is greater than 0.005 times the fan diameter D and less than 0.02 times the fan diameter D.

In another aspect of the invention, the free-tipped axial fan assembly is further characterized in that the angle, in a meridional plane, between the swept extent of the second portion of the blade tip and the direction of the fan axis decreases monotonically with respect to a tip coordinate which increases with distance along the swept extent of the blade tip from the blade tip leading edge to the blade tip trailing edge.

In another aspect of the invention, the free-tipped axial fan assembly is further characterized in that the distance between the swept extent of the second portion of the blade tip and the locally closest points on the portion of the inlet, measured perpendicular to the blade tip sweat extent, varies by no more than plus or minus 30 percent, or no more than plus or minus 20 percent, along the second portion of the blade tip.

In another aspect of the invention, the free-tipped axial fan assembly is further characterized in that the distance measured perpendicular to the blade tip swept extent, between the second portion of the blade tip and the inlet surface between two of the closest points is at least 20 percent greater than the average distance between the second portion of the blade tip and the two closest points.

In another aspect of the invention, the free-tipped axial fan assembly is further characterized in that the distance, mea tired perpendicular to the blade tip swept extent, between the second portion of the blade tip and the inlet surface between two of the closest points is at least 40 percent greater than the average distance between the second portion of the blade tip and the two closest points.

In another aspect of the invention, the free-tipped axial fan assembly is further characterized in that the minimum distance between the second portion of the blade tip and the closest points on the portion of the inlet, measured perpendicular to the swept extent of the blade tip, is greater than 0.005 times the fan diameter D and less than 0.02 times the fan diameter D.

In another aspect of the invention, the axial an assembly is further characterized in that the swept extent of the second portion of the blade tip conforms to an envelope curve, in a meridional plane, which passes through the points which are locally closest to the blade tip on the portion of the inlet.

In another aspect of the invention, the free-tipped axial fan assembly is further characterized in that the envelope curve is smooth.

In another aspect of the invention, the free-tipped axial fan assembly is further characterized in that the axial and radial coordinates of the envelope curve are each approximately given as the values of a spline curve, the spline curve being determined in the following manner:

1) creating a girth coordinate which follows piecewise linear cur e whose vertices are the points on the inlet through which the envelope curve passes,
2) generating cubic splines of the axial and radial coordinates with respect to the girth coordinate, with knots located at the vertices,
3) evaluating the splines at values of the girth coordinate that lie between the vertices.

In another aspect of the invention, the free-tipped axial fan assembly is further characterized in that the distance between the swept extent of the second portion of the blade tip and the envelope curve, measured perpendicular to the envelope curve, varies by no more than plus or minus 30 percent, or no more than plus or minus 20 percent, over the extent of the second portion of the blade tip.

In another aspect of the invention, the free-tipped axial fan assembly is further characterized in that the distance, measured perpendicular to the blade tip swept extent, between the second portion of the blade tip and the inlet surface at a point between two of the closest points is at least 20 percent greater than the local distance between the second portion of the blade tip and the envelope curve.

In another aspect of the invention, the free-tipped axial fan assembly is further characterized in that the distance, measured perpendicular to the blade tip swept extent, between the second portion of the blade tip and the inlet, surface at a point between two of the closest points is at least 40 percent greater than the local distance between the second portion of the blade tip and the envelope curve.

In at aspect of the invention, the free tippet axial tan assembly is further characterized in that the minimum distance between the swept extent of the second portion of the blade tip and the envelope curve, measured perpendicular to the envelope curve, is greater than 0.005 times the fan diameter D and less than 0.02 times the fan diameter D.

In another aspect of the invention, the free-tipped axial fan assembly is further characterized in that the envelope curve, in the region where the blade tip conforms to it, passes through at least 3 points on the inlet that are locally the closest to the blade tip.

In another aspect of the invention, the free-tipped axial fan assembly is further characterized in that the surface of the inlet portion is axisymmetric.

In another aspect of the invention, the free-tipped axial fan assembly is further characterized in that the shroud is a plastic, injection-molded part.

In another aspect of the invention, the free-tipped axial fan assembly is further characterized in that the shroud comprises features which facilitate mounting the fan assembly to a heat exchanger positioned upstream of the fan assembly.

In another aspect of the invention, the free-tipped axial fan assembly is further characterized in that the shroud comprises a plenum upstream of the barrel, which is mounted behind an upstream heat exchanger, where the area of heat exchanger face covered by the plenum is at least 1.5 times the fan disk area.

In another aspect of the invention, the free-tipped axial fan assembly is further characterized in that the angle varies non-monotonically in a plurality of meridional planes positioned over one or more ranges of azimuthal angle which totals greater than 180 degrees.

Other aspects of the invention will become apparent by consideration of the detailed description and accompanying drawings.

BRIEF DESCRIPTION OF THE DRAWINGS

FIG. 3*a* is an axial view of the suction side of a fan according to U.S. Patent Application Pub. No. 2014/0271172 and a barrel inlet having staggered rows of circular pockets.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
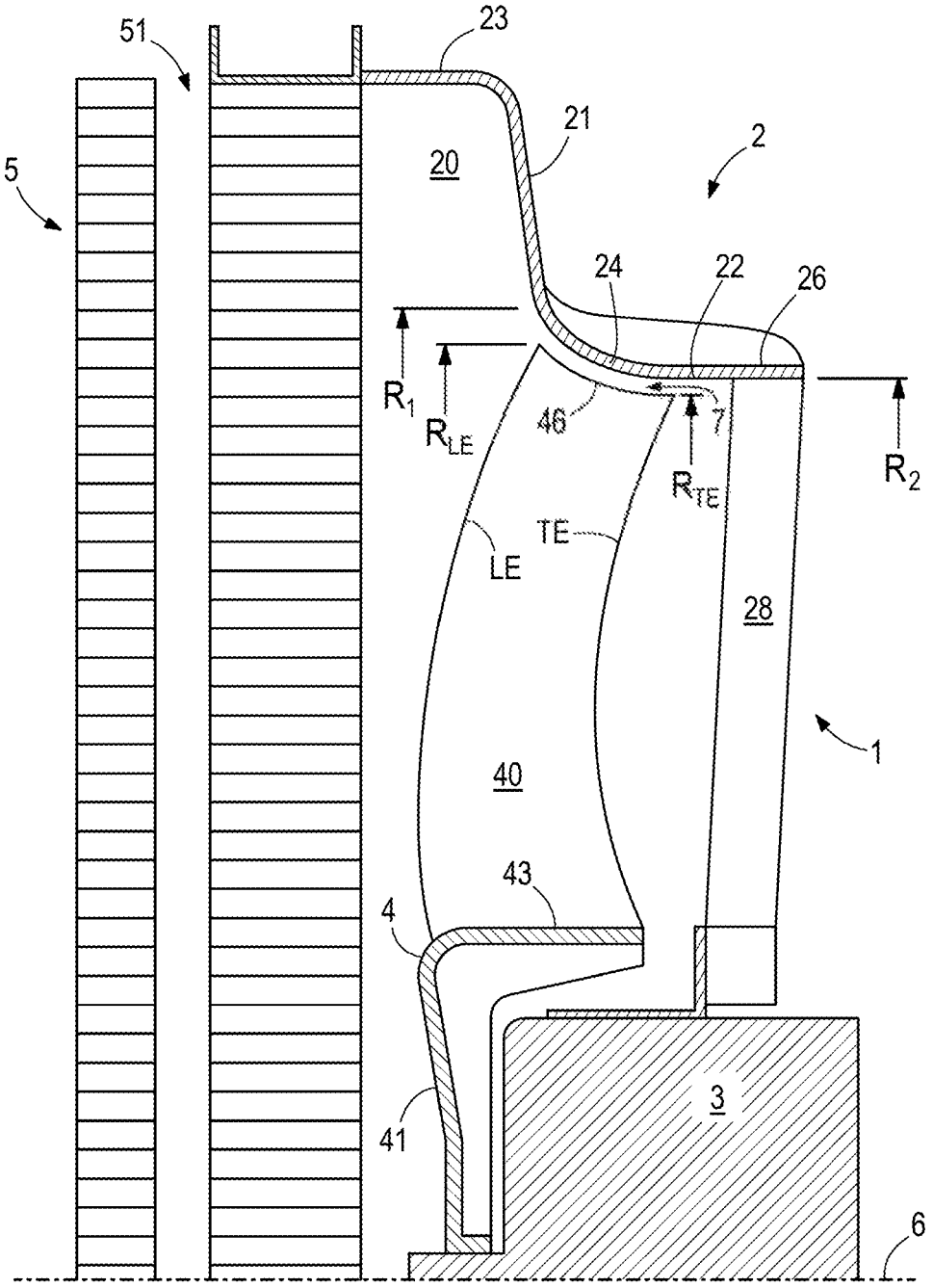
FIG. 1A Prior Art
FIG. 1*a* is a schematic view of a prior-art free-tipped axial fan assembly, showing a blade tip which conforms to the shape of a flared shroud barrel. The free-tipped axial fan assembly is configured as an engine-cooling fan assembly.

FIG. 1*a* shows a prior-art free-tipped axial fan assembly 1. In the illustrated construction, the free-tipped axial fan assembly 1 is an engine-cooling fan assembly mounted adjacent to at least one heat exchanger 5. In this construction, the heat exchanger(s) 5 includes a radiator 51, which cools an internal combustion engine (not shown). In alternatively-powered vehicles, the fan assembly 1 could be used in conjunction with one or more heat exchangers to cool batteries, electric motors, etc. A shroud 2 guides cooling air from the radiator 51 to a fan 4, surrounds the fan to control leakage, and provides supports 28 for the motor 3.

The shroud 2 comprises a plenum wall 21 and side walls 23 which together enclose a plenum 20. The plenum wall 21 is shown to have a small cone angle, but in other cases can lie in a plane approximately normal to the fan axis 6. The side walls 23 are shown to be parallel to fan axis 6, but will often have a draft angle to improve manufacturability. The shroud 2 further comprises a barrel 22 that surrounds the fan 4. The barrel 22 comprises a smoothly flared inlet 24 and a cylindrical portion 26 downstream of the flared inlet 24. The radial coordinate $R_1$ (measured from axis 6) of the entrance to the shroud inlet is larger than the radial coordinate $R_2$ of the exit where it joins the cylindrical portion 26. Although referred to as cylindrical, the portion 26 may be formed with a draft angle for manufacturability, such that it is not truly parallel with the axis 6. In either case, the portion 26 is distinguishable from the portion having the shape defining the flared inlet 24.

The fan 4 rotates about an axis 6 and comprises a hub 41 and a plurality of generally radially-extending blades 40. FIG. 1*a* shows the area in a meridional plane (a plane containing the fan axis) swept by these blades as the fan rotates. The end of each blade 40 that is adjacent to the hub 41 is a blade root 43, and the outermost end of each blade 40 is a blade tip 46. The blade tips 46 conform to the shroud barrel 22. In other words, the blade tips 46 are offset from the shroud barrel 22, but have a shape that follows or matches a contour defined by the shroud barrel 22. The radial coordinate of the blade tip leading edge $R_{LE}$ is larger than the radial coordinate of the blade tip trailing edge $R_{TE}$. The nominal fan radius R is taken to be equal to $R_{TE}$ and the fan diameter 13 is equal to 2 times R. A tip gap 7 provides a minimum running clearance between the blade tips 46 and the shroud barrel 22 which is between 0.005 D and 0.02 D.

Figure 1B:
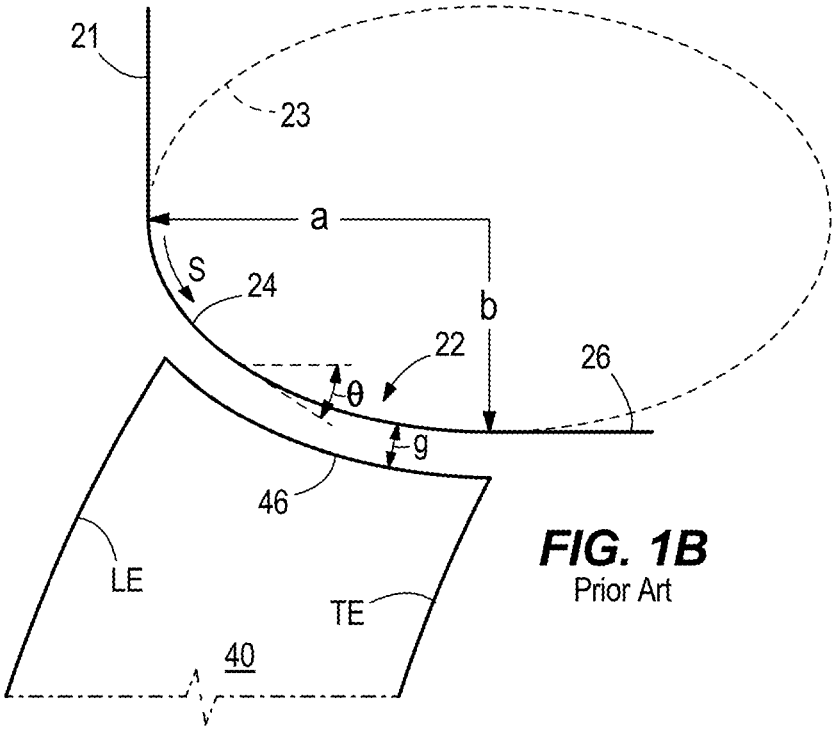
FIG. 1B Prior Art
FIG. 1*b* is a detailed schematic view in the meridional plane of the shroud barrel, of FIG. 1*a* and the swept area of the outermost portion of each blade.

FIG. 1*b* is a detailed schematic view in the meridional plane of the shroud barrel 22 of FIG. 1*a* and the area swept by the outermost portion of each blade 40. The flared inlet is approximately elliptical in shape, and the swept extent of the blade tip 46 is a smooth curve offset by an approximately constant distance "g" from the barrel 22. This distance represents the width of the clearance gap 7 between the blade tip 46 and the shroud barrel 22.

FIG. 1*b* also shows an inlet surface coordinate "s", which is zero where the inlet meets the plenum wall 21 and increases linearly with the distance along the inlet profile. Although the flared inlet shown in FIG. 1*b* is elliptical, other prior-art flared shrouds can differ somewhat from that shape. In all cases the angle "Θ", in a meridional plane, between the surface of the flared inlet 24 and the direction of the fan axis 6 decreases monotonically "s" increases.

Although FIG. 1*b* shows an approximately constant gap width, in other cases the gap is not constant from the leading edge to the trailing edge. In particular, it sometimes is designed so that the minimum axial distance between the blade tip and the shroud is greater than it would be in the case of a constant gap width. This is particularly advantageous when the predicted axial deflection of the blade tip is greater than the predicted radial deflection.

Although FIGS. 1*a* and 1*b* show the barrel 22 extending some distance downstream of the trailing edge TE of the blade tip 46, it is sometimes terminated very near the trailing edge E of the blade tip 46. This is often the ease at locations along the barrel circumference where there is no motor-support structure 2 downstream. At these locations, there is often little or no advantage aerodynamically to extending the barrel 22 further than is required to limit recirculation around the blade tip 46. In some cases, good performance can even be achieved with the barrel 22 terminated somewhat upstream of the blade tip trailing edge TE.

Although FIGS. 1*a* and 1*b* show the axial extent of the blade tip 46 being approximately equal to the axial extent of the flared inlet, this is sometimes not the case. In some cases, the blade tip extends past the end of the inlet, and into the approximately cylindrical portion of the barrel 22. In other cases the trailing edge TE of the blade tip 46 is at an axial location at which the angle of the flared inlet relative to the fan axis 6 is not yet zero. In the case of an elliptical shroud shape, this corresponds to a position upstream of the radial semi-axis "b".

In some cases the blade tip leading edge lies forward of the entrance to the inlet, and in other cases is well inside the entrance to the inlet.

Figure 1C:
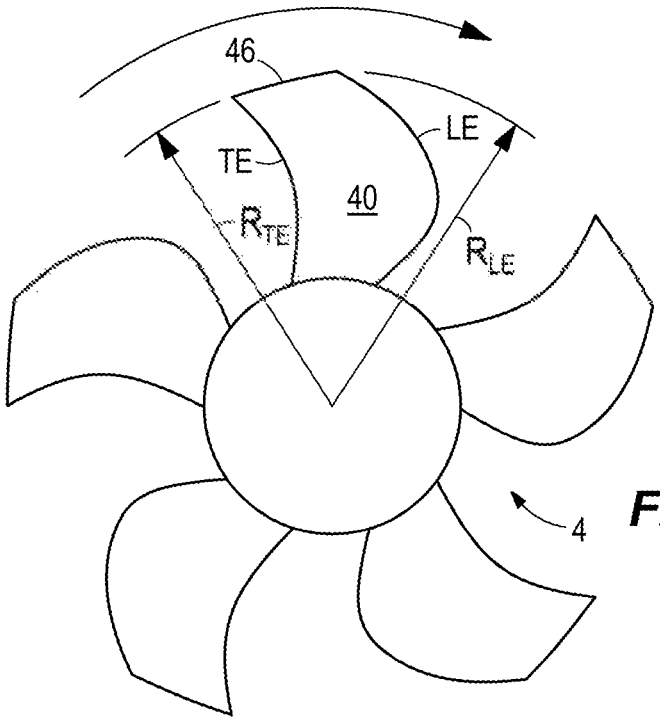
FIG. 1C Prior Art
FIG. 1*c* is a view from upstream of the fan, showing the leading and trailing edges and the blade tip.

FIG. 1*c* axial projection of the prior-art free-tip fan 4 with a blade tip that conforms to a flared shroud, as shown in FIGS. 1*a* and 1*b*. The rotation is clockwise, and the fan leading edge LE and trailing edge TE are as shown. The radius of the blade tip at the leading edge $R_{LE}$ is larger than that at the trailing edge $R_{TE}$.

Figure 2A:
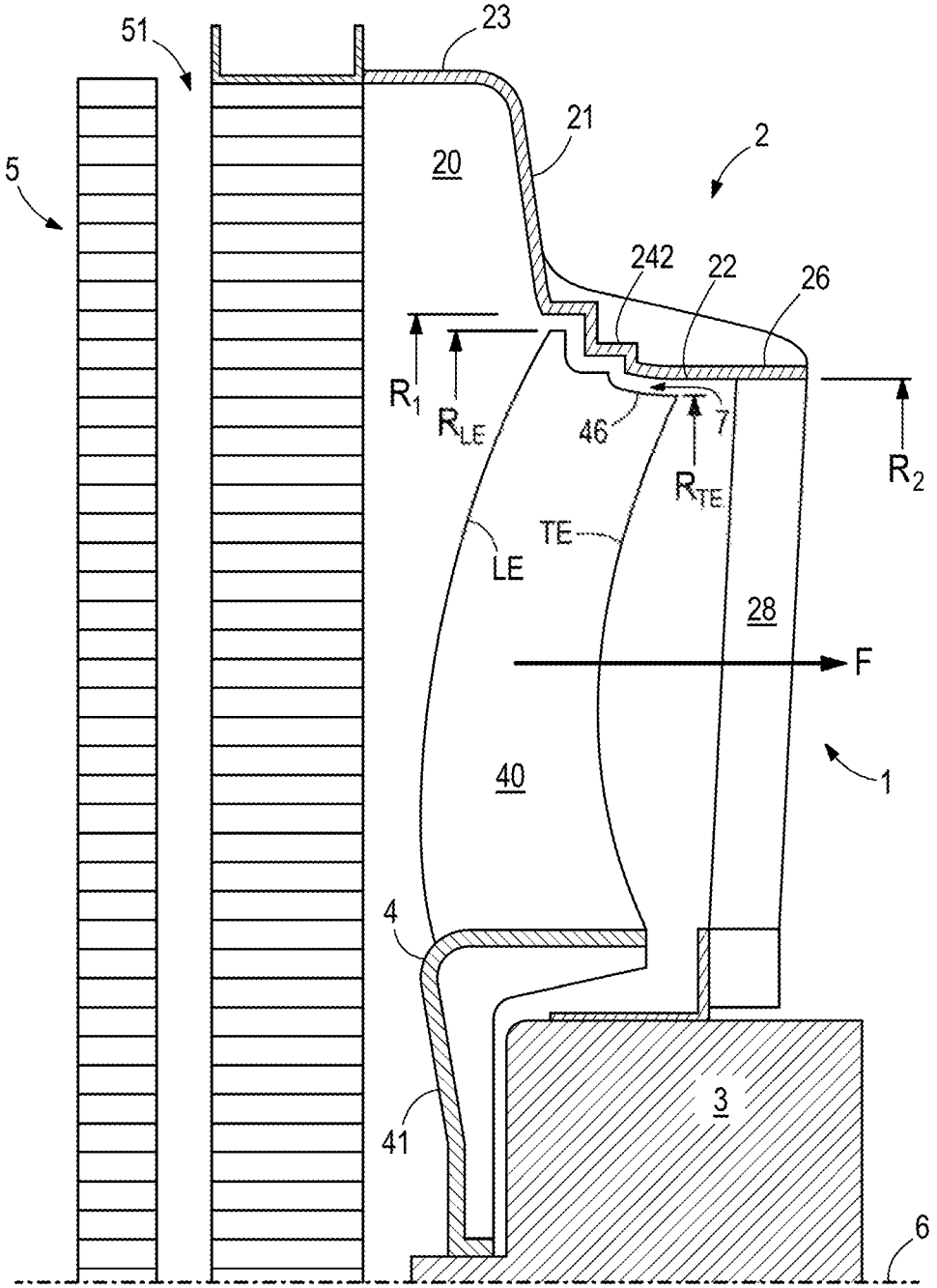
FIG. 2*a* is a schematic view of a free-tipped axial fan assembly according to one embodiment of the present application, with a shroud barrel comprising an inlet with a plurality of steps, and a fan blade tip which conforms to the stepped barrel.

FIG. 2*a* illustrates a free-tipped axial fan assembly according to one embodiment of the present application. Like the prior-art fan assembly of FIG. 1*a*, the barrel 22 comprises an inlet 242 characterized in that the radial coordinate if the inlet surface relative to the fan axis 6 is larger at the entrance to the inlet than it is at the exit. As such, the inlet defines a region of decreasing cross-sectional area in the axial flow direction F. In this example, the radial coordinate $R_1$ of the inlet at the axial location of the blade tip leading edge is larger than the radial coordinate $R_2$ of the inlet at the axial location of the blade tip trailing edge by approximately 6.8 percent of $R_2$. Unlike the engine-cooling fan assembly of FIG. 1*a*, the inlet 242 is not smoothly flared, but instead is stepped, each step, in the meridional plane, comprising an approximately radial (axial-facing) surface and an approximately axial (radial-facing) surface.

FIG. 2*a* shows a fan 4 which has blade tips 46 which conform to the steps. The radial extent (measured from axis 6) of the blade tip leading edge $R_{LE}$ is larger than the radial extent of the blade tip trailing edge $R_{TE}$. In this example, $R_{LE}$ exceeds $R_{TE}$ by approximately 6.9 percent of $R_{TE}$. A tip gap 7 provides a running clearance between the blade tips and the shroud barrel which in this example is approximately constant and equal to 1.0 percent of fan diameter D.

Figure 2B:
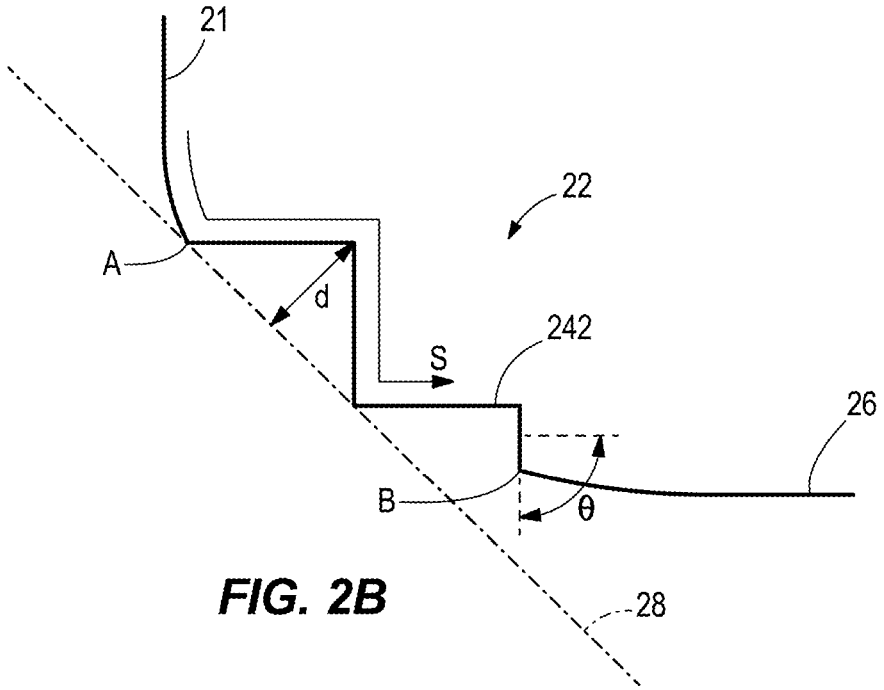
FIG. 2*b* is a detailed schematic view in the meridional plane of the shroud barrel of FIG. 2*a*.

FIG. 2*b* is a detailed schematic view in the meridional plane of the shroud barrel 22 of FIG. 2*a*. The barrel 22 comprises a stepped inlet 242 and an approximately cylindrical portion 26. Upstream of the inlet 242 is the plenum wall 21. The surface coordinate "s" zero at the point where the inlet meets the plenum wall 21, and increases linearly with distance along the stepped inlet surface until it meets the cylindrical portion 26.

In the case of the inlet shown in FIG. 2*b*, the radial coordinate of the surface monotonically decreases—that is, it either decreases or remains constant—as "s" increases. This characteristic allows the inlet to be made of injection-molded plastic with a simple injection-molding tool.

The stepped inlet shown in FIG. 2*b* has the additional characteristic that the axial coordinate (positive downstream) of the inlet surface monotonically increases—that is, it either increases or remains approximately constant—as the surface coordinate "s" increases. This characteristic is particularly favorable when designing injection-molding tooling.

The angle between the inlet surface and the fan axis, shown in FIG. 2*b* as "Θ", is approximately 90 degrees at the entrance to the inlet, and approximately 0 degrees at the exit from the inlet where it joins the cylindrical portion of the barrel, although variance may occur by providing a cone angle 5 degrees) as shown in the plenum wall 21 of FIG. 2*a*. Unlike the smoothly flared inlet of FIG. 1, as "s" increases, the angle "Θ" decreases from its value at the entrance to its value at the exit in a non-monotonic manner, varying from approximately 90 degrees along the approximately radial surfaces of the steps to approximately 0 degrees along the approximately axial surfaces of the steps. As viewed in cross-section along a meridional plane, the slope of the inlet surface is discontinuous between a point "A" and a point "B" (see FIG. 2*b*), and between these points is defined a region in which the angle "Θ" varies non-monotonically. In the region of non-monotonically varying angle "Θ", multiple steps are defined in the inlet surface, each step connecting two inlet surface segments at distinct radial coordinates.

FIG. 2*b* shows a straight line 28, touching two points on the inlet surface two consecutive protruding points) without intersecting the inlet surface, such that the straight line 28 represents a straightedge placed against the inlet surface. The distance "d" between the straight line 28 and the barrel surface at a point lying between the two points at which the straight line 28 touches the inlet surface, measured normal to the straight line 28, is shown to be at least 1.0 percent of the fan diameter D (e.g., 1.5 percent of the fan diameter D).

Figure 2C:
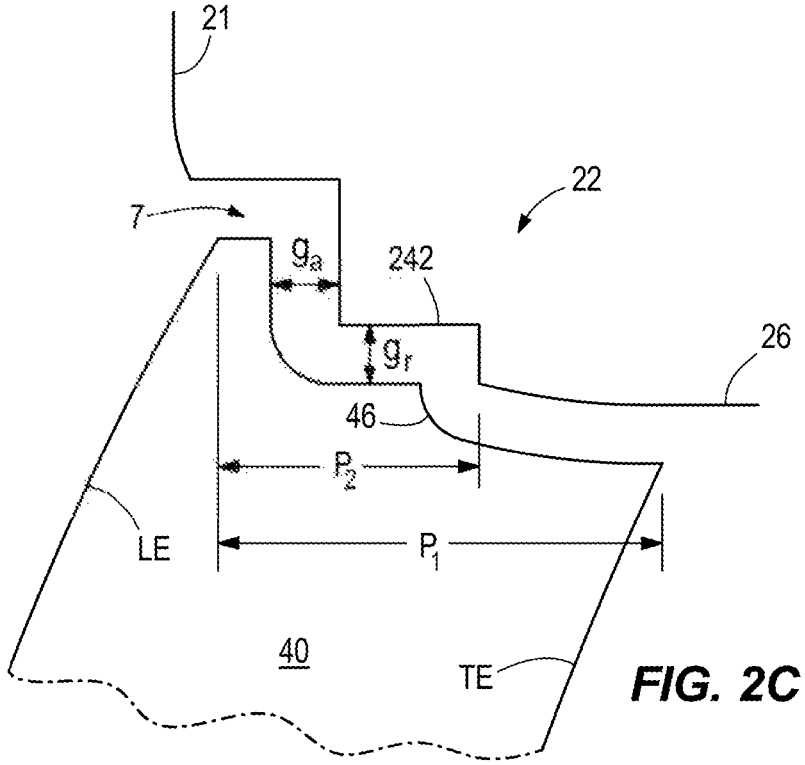
FIG. 2*c* is a detailed schematic view in the meridional plane of the shroud barrel of FIG. 2*a* and the area swept by the outer portion of each blade.

FIG. 2*c* is a detailed schematic view in the meridional plane of the shroud barrel 22 of FIG. 2*a* and the area swept by the outermost portion of each blade 40. The portion $P_1$ of the blade tip which lies within the axial extent of the barrel inlet is equal to the entire axial extent of the blade tip between the leading edge LE and the trailing edge TE. The region of non-monotonically varying angle "Θ" extends at least over the upstream most 50 percent of the axial extent of the portion of the inlet which overlaps with the portion $P_1$. The portion of the blade tip which lies within the axial extent of the region of non-monotonically varying angle is designated as a second portion $P_2$ of the blade tip.

The swept extent of the blade tip 46 in FIG. 2*c* is stepped to conform to the stepped inlet, and is offset from the inlet by radial gaps "$g_r$" and axial gaps "$g_a$", which may be equal, as shown, or may differ. In particular, it is sometimes beneficial to set $g_a$ larger than $g_r$. This is particularly advantageous when the predicted axial deflection of the blade tip is greater than the predicted radial deflection. A typical minimum distance between the blade tip and the inlet is between 0.005 and 0.02 times the fan diameter D.

Figure 3A:
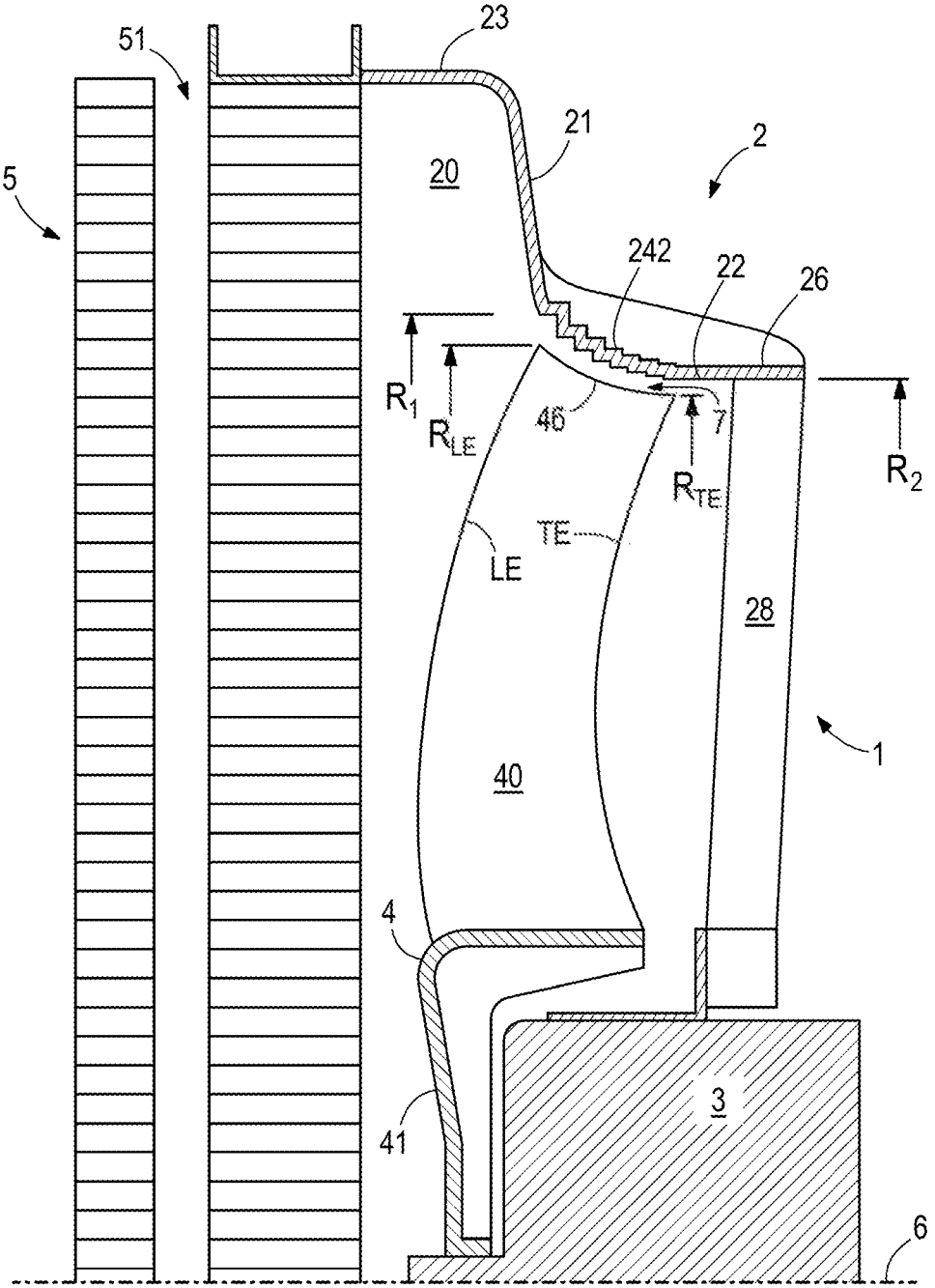
FIG. 3*a* is a schematic view of a free-tipped axial fan assembly according to one embodiment of the present application, with a shroud barrel comprising an inlet with a plurality of steps, and a fan blade tip which conforms to a smooth envelope curve which passes through the locally closest points on the barrel.

FIG. 3*a* illustrates a free-tipped axial fan assembly similar to that of FIG. 2*a*, but with certain differences as discussed below. The above description is relied upon for disclosure of similar features. Rather than conforming to the stepped inlet 242 the blade tips 46 conform tar an envelope curve which passes through the points on the shroud barrel which are locally the closest to the fan blade tip. As in FIG. 2*a*, the radial extent (measured from axis 6) of the blade tip leading edge $R_{LE}$ is larger than the radial extent of the blade tip trailing edge $R_{TE}$. The inlet surface of the barrel 22 is formed with an increased number of steps compared to the inlet surface of the fan assembly of FIGS. 2*a* to 2*c*.

Figure 3B:
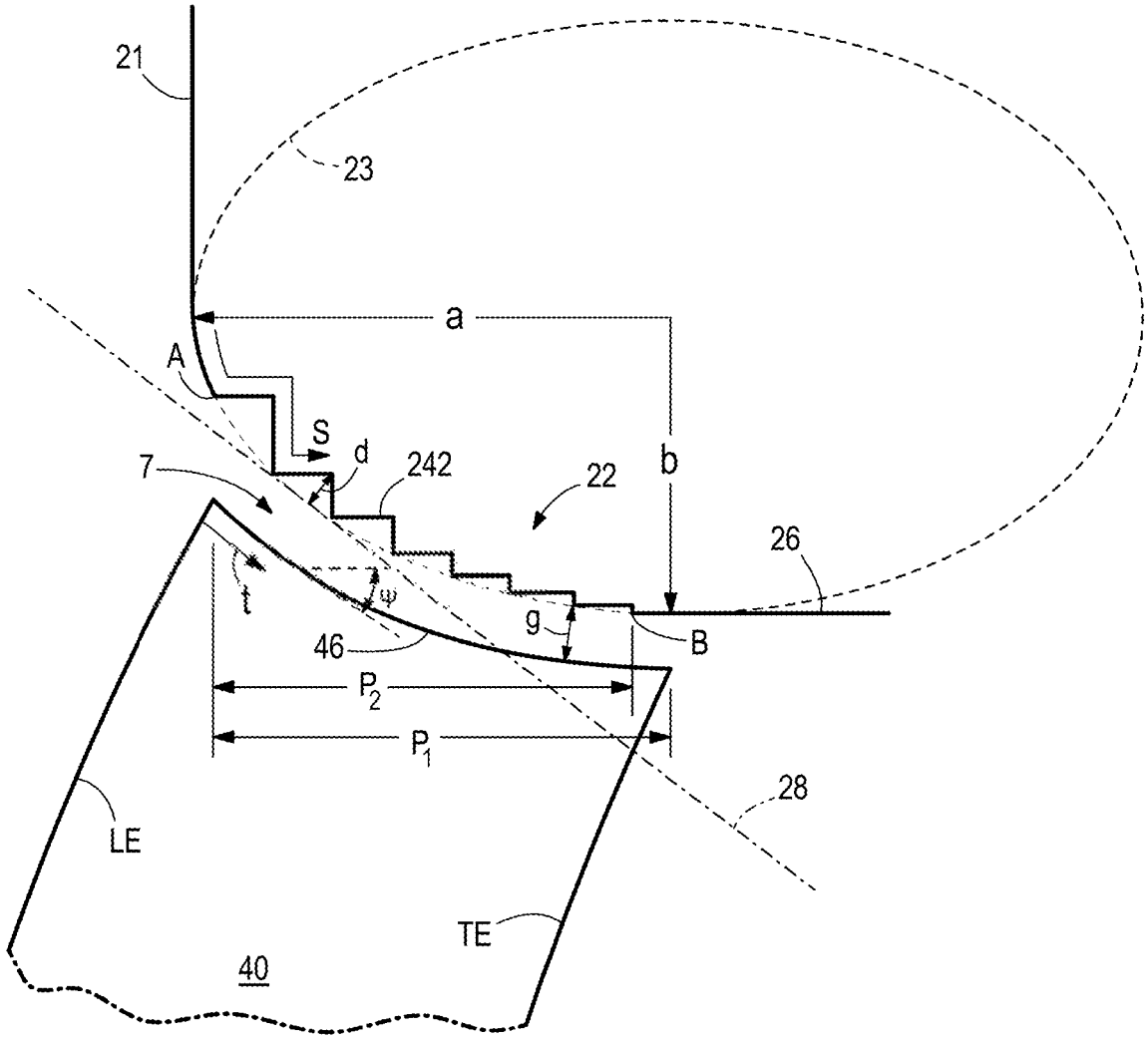
FIG. 3*b* is a detailed schematic view in the meridional plane of the shroud barrel of FIG. 3*a* and the area swept by the outermost portion of each blade.

FIG. 3*b* is a detailed schematic view in the meridional plane of the shroud barrel 22 and the area swept by the outermost portion of each blade 40 of FIG. 3*a*. In this example the envelope curve which passes through the points on the barrel which are locally the closest to the fan blade tip forms a portion of an ellipse with axial semi-radius "a" and radial semi-axis "b". The swept extent of the blade tip is a curve offset by an approximately constant distance "g" from the envelope curve. In this example, "g" approximately 1.0 percent of fan diameter D. A tip coordinate "t" increases linearly with distance along the swept extent of the blade tip from the blade leading edge to the blade trailing edge. The angle "ψ", in a meridional plane, between the swept extent of the blade tip and the direction f the fan axis 6 decreases monotonically as "t" increases. In the construction shown in FIG. 3*b*, the swept extent of the blade tip is a smooth curve, in that the angle "ψ" is a continuous function of "t". In other constructions, the blade tip swept extent is not smooth, in that the angle "ψ" is not a continuous function of "t", but such constructions can still feature an angle "ψ" which decreases monotonically as "t" increases.

As viewed in cross-section along a meridional plane, the slope of the inlet surface is discontinuous between a point "A" and a point "B" (see FIG. 3*b*), and between these points is defined a region in which the angle "Θ", between the inlet surface and the direction of the fan axis as defined above, varies bon-monotonically. The portion $P_1$ of the blade tip which lies within the axial extent of the inlet is the entire axial extent of the blade tip. The region of non-monotonically varying angle "Θ" lying between points A and B extends at least over the upstream most 50 percent of the axial extent of the portion of the inlet which overlaps with the axial extent of the blade tip. The portion of the blade tip which lies within the axial extent of the region of non-monotonically varying angle is designated as a second portion $P_2$ of the blade tip.

FIG. 3*b* shows a straight line 28 which is touches the inlet surface at two points, both of which are within the axial extent of the blade tip, without intersecting the inlet surface. This represents a straightedge placed against the inlet surface. The distance "d" between this straight line and THE barrel surface at a point lying between the two points at which the straight line touches the inlet surface, measured normal to the straight line 28, is shown to be approximately 0.5 percent of the fan diameter D. In this particular example, this measurement represents a maximum value of step depth—if a similar measurement is made closer to the trailing edge TE of the blade tip 46, the distance is less. This maximum step depth d can be used as a metric to compare different inlet designs. The maximum step depth d within the axial extent of the blade tip 46 can be 0.2 percent of fan diameter D or greater, and in some constructions the maximum step depth d is greater than 0.3 percent, or even greater than 0.4 percent of fan diameter D. Although limiting to the quantity of steps that can be provided along the inlet surface, the maximum step depth d within the axial extent of the blade tip 46 may even be greater than 0.5 percent of the fan diameter D.

FIG. 3*b* the distance "g" represents the width of the clearance gap 7 only at the points where it is locally at a minimum. Although FIG. 3*b* shows an example where the distance "g" is constant from the blade leading edge to the blade trailing edge, in other embodiments it can vary over this distance. In particular, it sometimes is designed so that the minimum axial distance between the blade tip and the shroud is greater than it would be in the case of a constant value of "g". This is particularly advantageous when the predicted axial deflection of the blade tip is greater than the predicted radial deflection. Over the blade tip 46, the extent of the variation of the distance "g" to the locally closest points is less than plus or minus 30 percent of its average value, and may be less than plus or minus 20 percent of its average value. A minimum value of the distance can be between 0.005 and 0.02 times the fan diameter D.

Although the distance "g" represents the width of the clearance gap 7 between the blade tip and the locally closest points on the shroud, at other points the gap 7 can be significantly greater than dimension "g". In the example of FIG. 3*b* the width of the clearance gap 7, measured normal to the blade tip swept extent, is as much as 50 percent greater than the local value of the dimension "g" at a position between two locally closest points. This locally maximum width of the clearance gap 7 between points locally closest to the blade tip 46 may be at least 20 percent greater than the local value of dimension "g", and in some constructions, is at least 30 percent or at least 40 percent or even at least 50 percent greater than the local value of the dimension "g".

The blade tip 46 shown ria FIG. 3*b* extends over the entire extent of the ellipse defining the envelope curve and the depth of the steps in the region of the blade tip trailing edge TE is small. However, the inlet can be smooth (i.e., not stepped) over a portion of the inlet having an axial extent toward the trailing e of the blade tip 46. In some aspects, the steps extend over at least the upstream most 50 percent of, and more specifically a majority of, the axial extent of the portion of the inlet which overlaps with the axial extent of the blade tip 46.

Figure 3C:
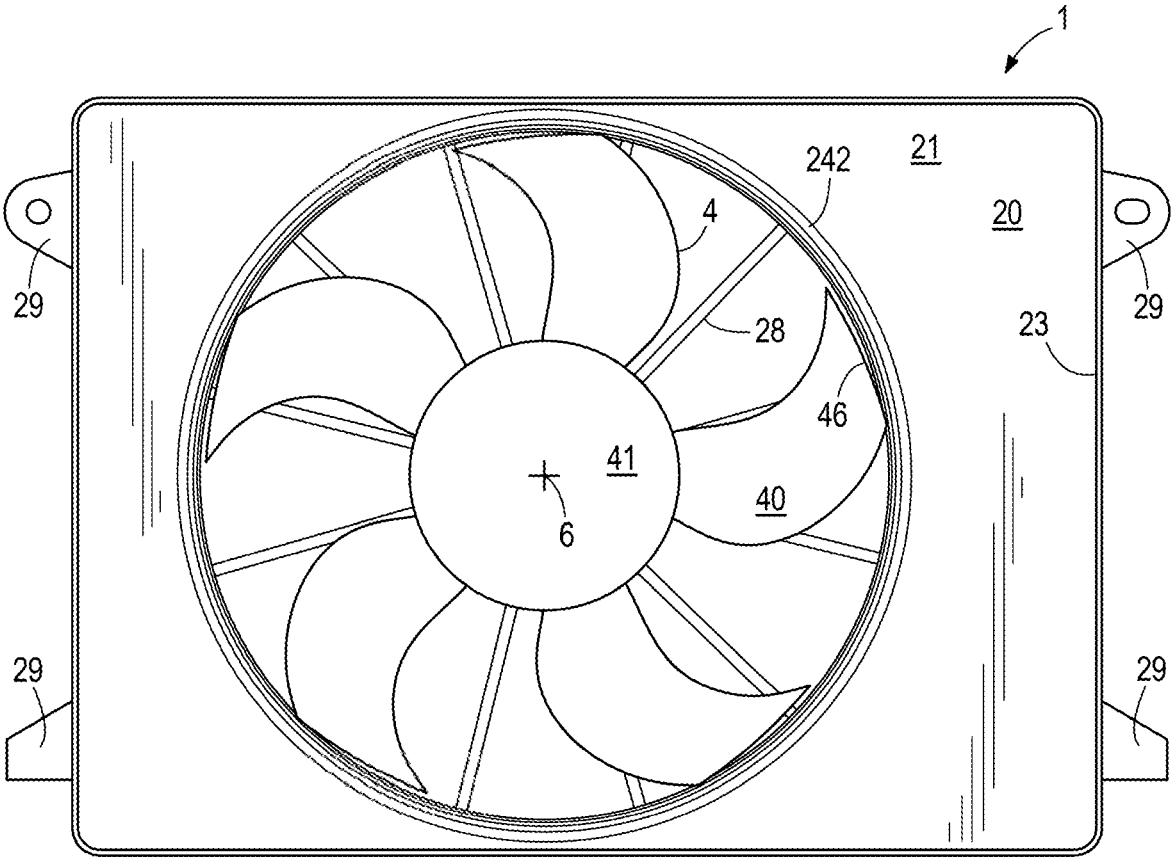
FIG. 3*c* shows a planform view (from upstream, looking downstream) of the free-tipped axial fan assembly of FIG. 3*a*, showing a rectangular shroud plenum.

FIG. 3*c* shows a platform view (from upstream, looking downstream) of the free-tipped axial fan assembly of FIG. 3*a*. Shroud 2 has an approximately rectangular plenum 20 enclosed by an approximately rectangular plenum wall 21 and side walls 23 which extend axially from the outside edges of the plenum wall to an upstream heat exchanger which is not shown. The area of the heat exchanger covered by the plenum is approximately 2.14 times the fan disk area, which is defined as the area of a circle with a diameter equal to the fan diameter D. The shroud features brackets 29 which engage with mounting features on the heat exchanger. The shroud features a stepped barrel inlet 242 and an array of motor supports 28. Although FIG. 3*c* shows a fan assembly with a single fan, other constructions have multiple fans in a single shroud. In these constructions, a relevant metric of heat exchanger area is the ratio of that area to the total disk area of all of the fans.

The axial projection of fan 4 shown in FIG. 3*c* is the same as that of the prior-art free-tip fan shown in FIG. 1*c*. Although this fan has forward sweep near the blade root and backward sweep at the blade tip, other embodiments can exhibit other distributions of sweep. Similarly, although the fans of FIGS. 2 and 3 have rake distributions similar to that of the prior-art fan shown in FIG. 1*a*, other embodiments can exhibit other rake distributions.

FIGS. 2 and 3 both show fan assemblies where all of the steps on the inlet have axial surfaces with the same axial extent, and radial surfaces of varying radial extent. In other embodiments all of the steps have radial surfaces with the same radial extent and axial surfaces of varying axial extent.

Still another possibility is to make the depth, normal to an envelope curve, constant for all the steps. Other configurations are also possible.

Figure 4A:
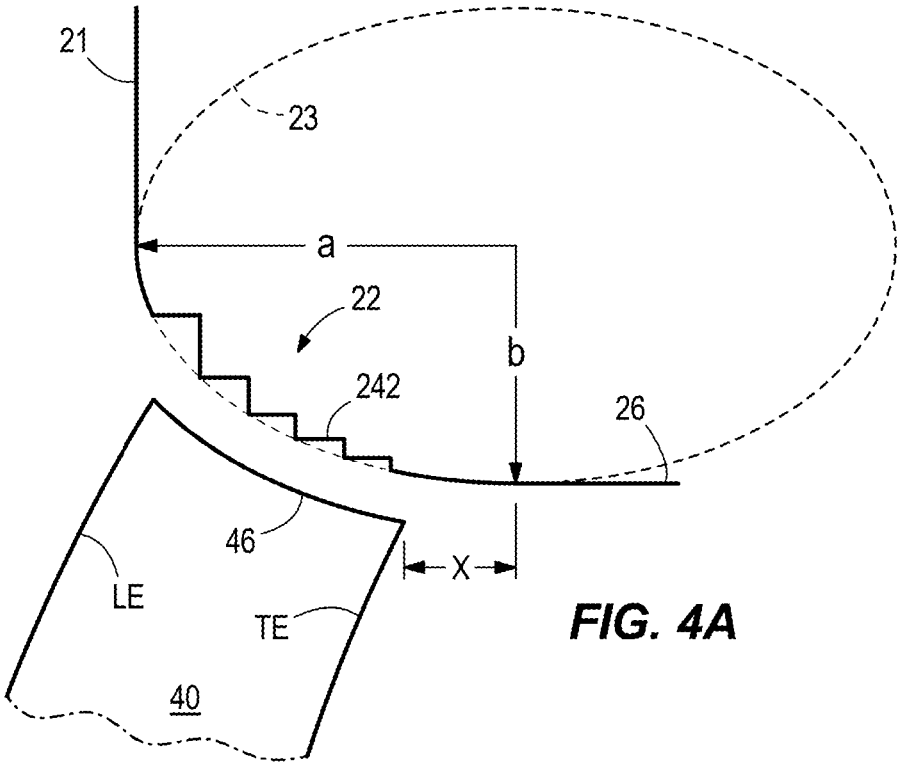
FIG. 4*a* is a detailed schematic view in the meridional plane of a shroud barrel and the swept area of the outer portion of a blade where the axial extent of the blade tip is less than the axial semi-axis of the ellipse defining the envelope curve of the closest points on the inlet.

FIG. 4*a* is a detailed schematic view in the meridional plane of a shroud barrel 22 and the swept area of the outer portion of a blade 40 where, as in FIG. 3*a*, the smooth envelope curve which passes through the points on the barrel which are locally the closest to the fan blade tip forms a portion of ellipse 23 with axial semi-radius "a" and radial semi-axis "b". In this case, the axial extent of the blade tip 46 is less than the axial semi-axis of the ellipse 23, and the blade tip trailing edge TE is a distance "X" upstream of the ellipse radial axis. This allows the steps near the blade tip trailing edge TE to be deeper, and more effective, than the steps near the blade tip trailing edge TE of the fan of FIG. 3*b*. The portion of the inlet downstream of the blade tip trailing edge TE is smooth, without steps. The performance or this fan assembly may not be enhanced significantly by extending the steps downstream of the blade tip trailing edge.

Figure 4B:
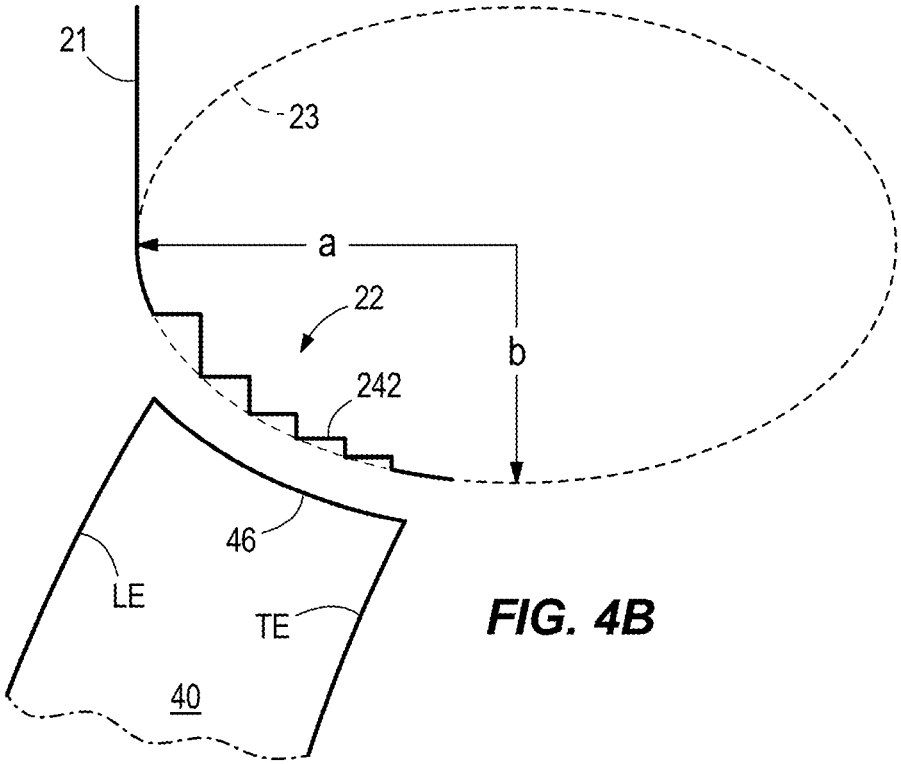
FIG. 4*b* is a detailed schematic view in the meridional plane of a shroud barrel and the swept area of the outer portion of a blade where the axial extent of the blade tip is less than the axial semi-axis of the ellipse defining the envelope curve of the closest points on the inlet, and the barrel is terminated near the trailing edge of the blade.

FIG. 4*b* is similar to 4*a*, but in this example the barrel 22 is terminated near the trailing edge TE of the fan. This configuration is often used at the circumferential locations between the motor-support structures 28 shown in FIG. 3*a*.

Figure 4C:
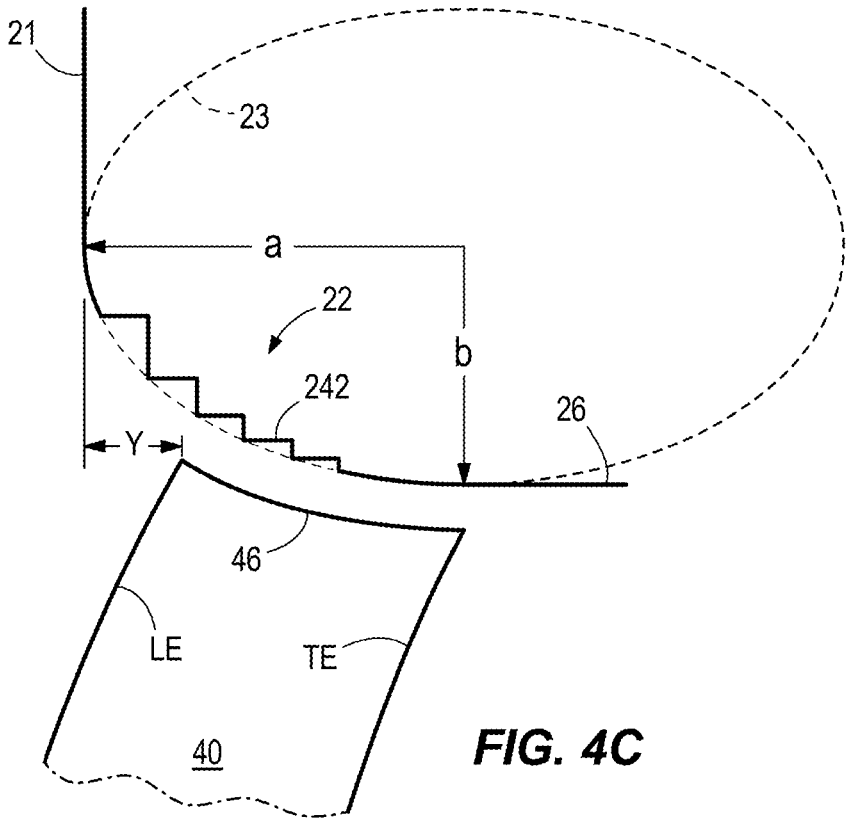
FIG. 4*c* is a detailed schematic view in the meridional plane of a shroud barrel and the swept area of the outer portion of a blade where the axial extent of the blade tip is less than the axial semi-axis of the ellipse defining the envelope curve of the closest points on the inlet and the fan is positioned with the tip trailing edge located at the radial semi-axis of the ellipse.

FIG. 4*c* also shows a case rig the axial extent of the blade tip 46 is less than axial semi-axis "a" of the ellipse 23 defining the envelope curve through the closest points on the inlet. Here the fan is positioned with the tip trailing edge TE located at the radial semi-axis "b" of the ellipse 23, and the blade tip leading edge LE is a distance "Y" downstream of the entrance to the shroud barrel 22. The steps extend forward of the blade tip leading edge LE, covering at least the downstream-most 50 percent of the axial extent of a second portion of the inlet, which lies upstream of the leading edge LE of the blade tip 46. The noise performance of this fan assembly is significantly better than that of a similar assembly where the steps do not extend forward of the blade tip leading edge LE.

Figure 5A:
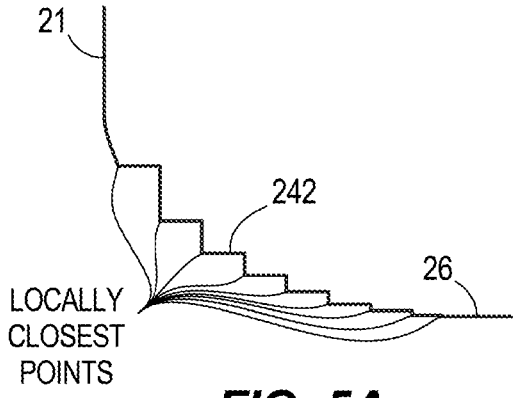
FIG. 5*a* is a meridional view of a stepped shroud barrel showing the points on the inlet which are closest to the blade tips, not shown.

Although the envelope curves in FIGS. 3*b* and 4*a-c* form a portion of an ellipse, other shapes can also yield good results. In some embodiments the coordinates of the envelope curve are formed as spline curves through knots corresponding to the points on the shroud which are locally the closest points to the blade tip 46. These "locally closest" points are identified in FIG. 5*a*.

Figure 5B:
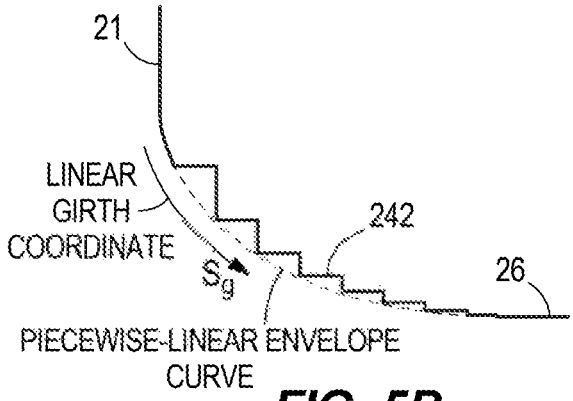
FIG. 5*b* is a meridional view of a stepped shroud barrel showing a piece-wise linear envelope curve and defining a girth parameter.

FIG. 5*b* shows an envelope which is linear between the closest points. It also defines a girth coordinate "$s_g$", which increases linearly along the length of this envelope. Such an envelope possesses the quality that the angle, in a meridional plane, between the envelope and the direction of the fan axis 6 decreases monotonically as "$s_g$" increases.

Figure 5C:
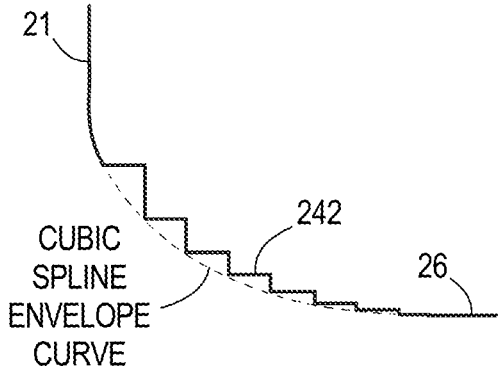
FIG. 5*c* is a meridional view of a stepped shroud barrel showing a smooth envelope curve whose coordinates are defined by cubic spline functions.

FIG. 5*c* shows a smooth envelope curve having a axial and radial coordinates that follow a cubic spline whose knots are the axial and radial coordinates of the closest points of the inlet, and whose independent variable is the coordinate "$s_g$". The end conditions of those splines are such that the smooth envelope cure blends with the shroud surface outside the region of non-monotonic angle variation.

Figure 5D:
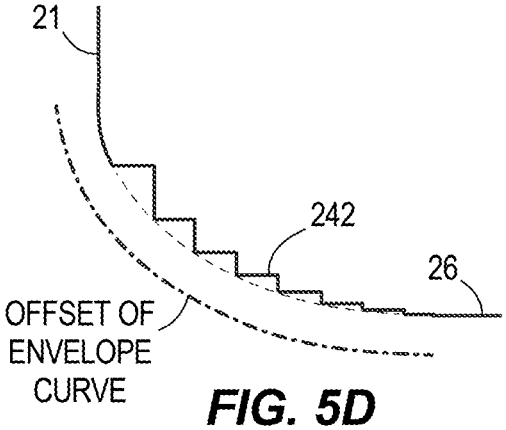
FIG. 5*d* is a meridional view of a stepped shroud barrel showing a curve which is offset from the smooth envelope curve of FIG. 5*c*.
Figure 5E:
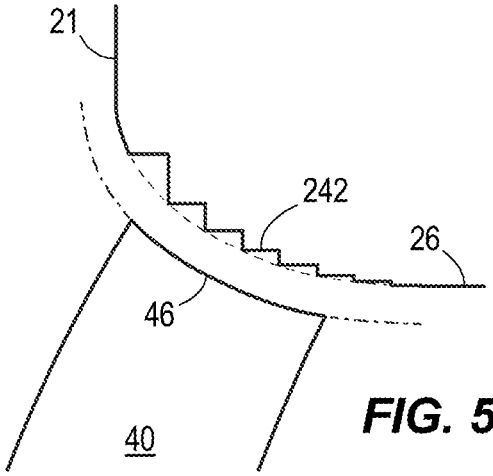
FIG. 5*e* is a meridional view of a stepped shroud barrel and the area swept by a blade where the blade tip swept extent follows the offset curve of FIG. 5*d*.

FIG. 5*d* shows a curve which is offset from the smooth envelope curve of FIG. 5*c* by a constant distance, and FIG. 5*c* shows the swept area of a tan blade where the blade tip swept extent follows the offset curve.

Figure 6A:
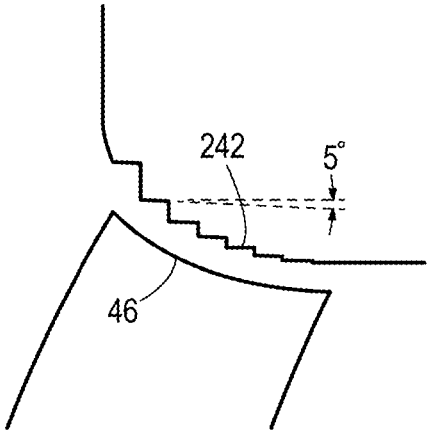
FIG. 6*a* is a meridional view of a stepped shroud barrel and the swept area of a blade where there is draft angle on the approximately axial surfaces of the steps.

Although FIGS. 2, 3, 4, and 5 show stepped barrel inlets with steps having axial and radial races, other geometries are also effective. FIG. 6*a* shows a stepped barrel inlet 242 which has a draft angle on the portions of the inlet which in FIGS. 2-5 are axial. The draft angle shown is 5 degrees. Draft can improve the moldability of a plastic part, and does not compromise the performance of the fan assembly to a significant degree.

Figure 6B:
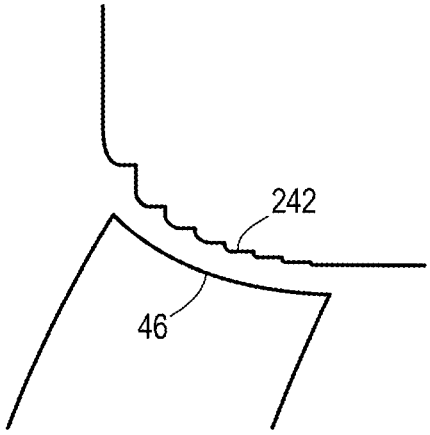
FIG. 6*b* is a meridional view of a stepped shroud barrel and the swept area of a blade where the exterior corners of the steps are radiused.

FIG. 6*b* shows a stepped barrel inlet 242 where the external corners of the steps—the corners closest to the blade tips—are radiused. Although radiusing the corners causes a small loss in performance relative to a stepped barrel with sharp corners, the loss is minimized if the envelope curve is redefined to include the effect of the corner radii, and the offset between the blade tip 46 and the envelope curve is maintained.

Figure 6C:
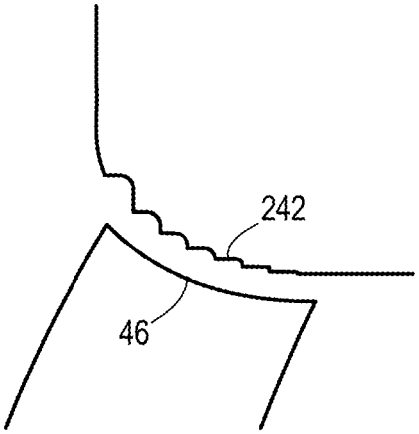
FIG. 6*c* is a meridional view of a stepped shroud barrel and the swept area of a blade where the interior corners of the steps are radiused.

FIG. 6*c* shows a stepped barrel inlet 242 where the inside corners of the steps are radiused. In the case of a molded plastic part, the advantage of such a radius is that the molten plastic can more easily fill the tool during manufacture. Although such a radius can cause a loss in performance relative to a stepped barrel without radiused corners, this loss is generally less than the case of a stepped inlet where the radii are applied to the external corners, as shown in FIG. 6*b*.

FIGS. 6*a*-6*c* show modifications to a stepped barrel inlet which may improve the manufacturability of a molded part. They are not mutually exclusive, in that any combination of these, or similar, modifications can be used on the same shroud barrel.

Figure 6D:
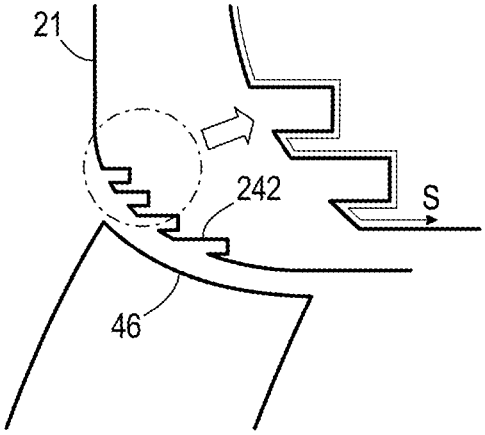
FIG. 6*d* is a meridional view of a shroud barrel and the swept extent of a blade where the inlet to the barrel has axial grooves.

FIG. 6*d* shows a barrel inlet 242 which comprises axial grooves. The expanded view shows the inlet surface coordinate "s", which is zero where the inlet meets the plenum wall 21 and increases linearly with the distance along the inlet profile. As in the case of the stepped inlet of FIGS. 2-5, "s" increases, the radial dimension either decreases or is held constant. However, unlike the case of a stepped inlet, as "s" increases, the axial dimension (positive downstream) does not necessarily either increase or remain constant. Instead, it can decrease, as well. The inclusion of axial grooves as shown in FIG. 6*d* can improve the performance of a free-tipped axial fan assembly when compared with a fan assembly with a smoothly flared shroud inlet.

Figure 6E:
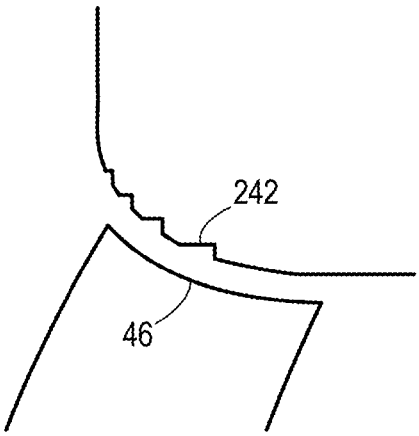
FIG. 6*e* is a meridional view of a shroud barrel and the swept extent of a blade where the inlet to the barrel has steps which are not continuous.

FIG. 6*e* shows a stepped barrel inlet 242 where the steps are not continuous, but are separated by portions of smoothly flared shroud. In general, such a configuration is less effective than one where the steps are continuous. This may account for the some of the performance deficit of an inlet with axial grooves relative to a continuously stepped inlet.

Figure 6F:
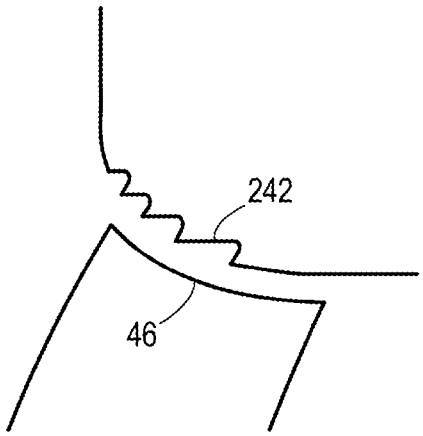
FIG. 6*f* is a meridional view of a shroud barrel and the swept area of a blade where the inlet to the barrel has steps with axial surfaces and surfaces which are angled relative to the radial direction.

FIG. 6*f* shows a configuration where the non-axial surfaces of the stepped inlet are not radial, but instead form, in the meridional plane, an acute angle (e.g., a 30 degree angle) with the radial direction. The radial extent of the angled portions of the four steps are constant in this example. This configuration offers the added depth of a grooved inlet and the continuous nature of a stepped inlet. Although superior to a smoothly flared inlet, such a configuration may be less effective than one where the step surfaces are approximately perpendicular to each other.

Figure 7C:
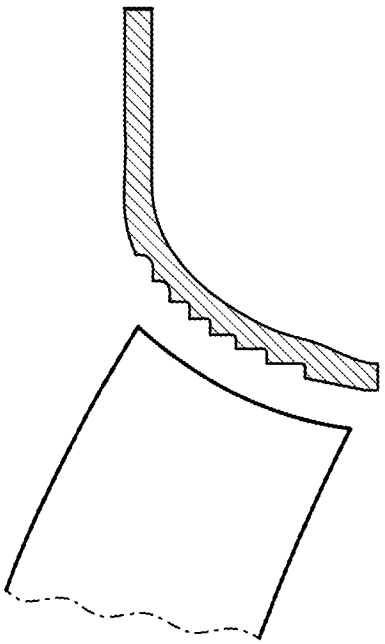
FIG. 7*c* shows both sides of a stepped shroud barrel where the depth of the steps is small compared to the thickness of the barrel, and the outside surface of the barrel is smooth.
Figure 7B:
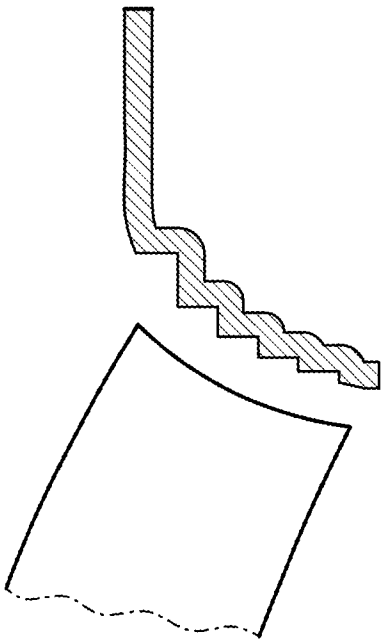
FIG. 7*b* shows both sides of a stepped shroud barrel where the external steps are radiused.
Figure 7A:
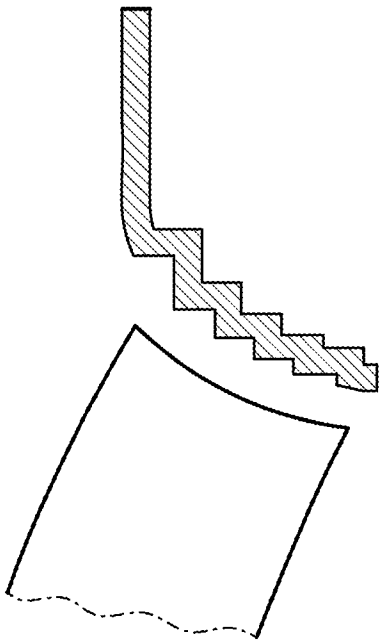
FIG. 7*a* shows both sides of a stepped shroud barrel where the depth of the steps is comparable to the thickness of the barrel, and the outside surface of the barrel is also stepped.

FIGS. 4, 5, and 6 only show the inside surface of the shroud barrel. The exterior of the barrel can in some cases follow the shape of the interior, as shown in FIGS. 2*a* and 3*a*. FIG. 7*a* is a meridional section through the shroud barrel whose inner surface is shown in FIG. 4*b*. In this example the outer surface is offset from the inner surface by an approximately constant amount. FIG. 7*b* shows a meridional section through a shroud barrel where the external corners are radiused. This reduces the amount of material used, and in the case of an injection-molded shroud may improve plastic flow during manufacture. To further improve moldability the internal corners on the outer and inner surfaces can also be radiused, and draft angle can be applied to both the outer and inner surface.

In cases where the steps in the shroud are relatively shallow, an alternative approach is to make the exterior of the barrel a smooth surface. This is illustrated in FIG. 7*c*. The steps in this example all have the same depth normal to the elliptical envelope curve. The internal corners are radiused to improve the flow of plastic material into the tool.

Figure 8A:
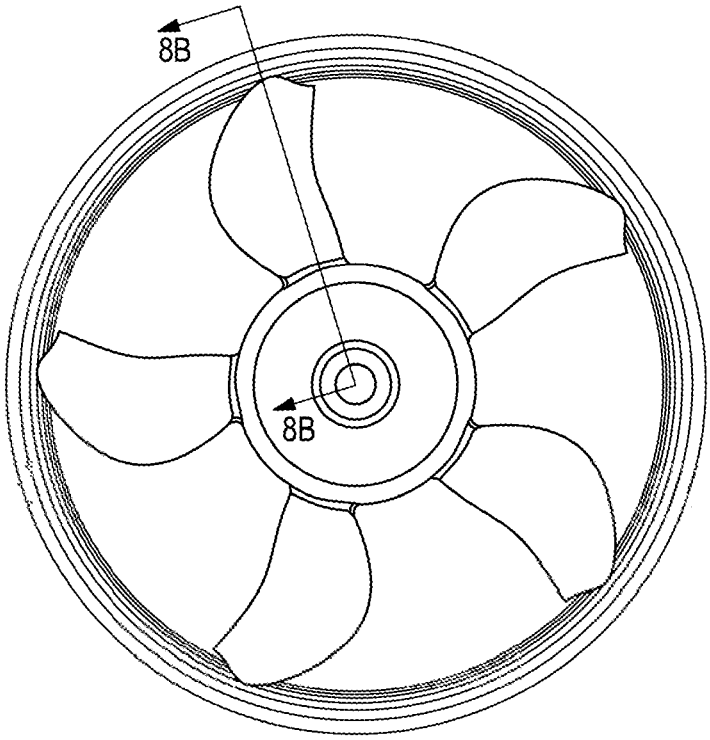
FIG. 8*a* is an axial view of the suction side of a fan according to U.S. Patent Application Pub. No. 2014/0271172 and a stepped barrel inlet according to one embodiment of the present application.
Figure 8B:
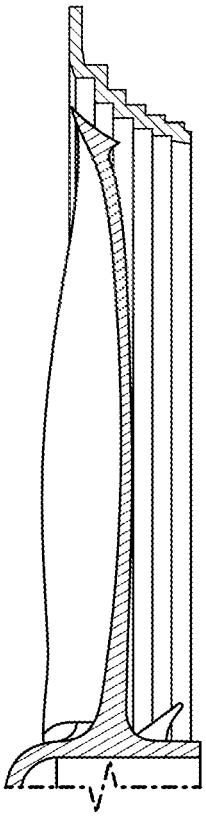
FIG. 8*b* is a meridional section through the blade and barrel inlet at an angle corresponding to the point of maximum thickness at the blade tip, as indicated in FIG. 8*a*.
Figure 8C:
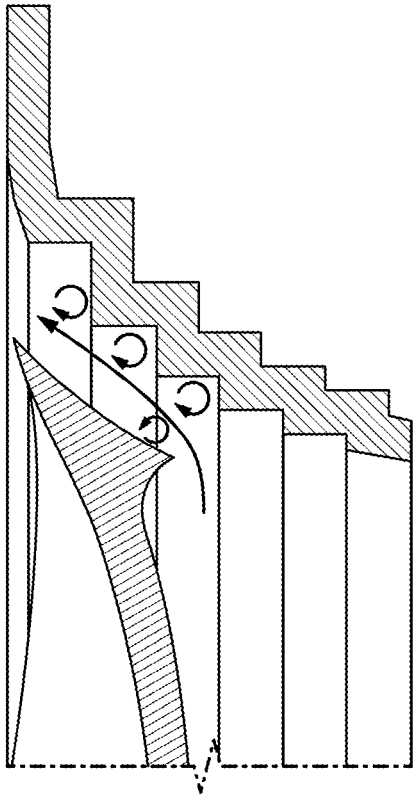
FIG. 8*c* is da detailed view of the tip region of FIG. 8*b*.

FIG. 8*a* is an axial view of the suction side of a fan according to U.S. Patent Application Pub. No. 2014/0271172 and a stepped barrel inlet according to an embodiment of the present application. In this view the fan rotates in the counter-clockwise direction. FIG. 8*b* is a meridional section through the blade and barrel inlet at an angle corresponding to the point of maximum thickness at the blade tip, as indicated in FIG. 8*a*. The barrel inlet is the same tis shown in FIG. 7*a*. FIG. 8*c* is a detailed view of the tip region of FIG. 8*b*, with a schematic sketch of the flow leaking past the blade tip and the vorticity generated at regions of flow separation. In addition to the separated region where the pressure side of the blade meets the inlet to the clearance gap, there is in addition flow separation at the radial surfaces of each step of the shroud inlet. These separated zones may reduce the flow through the tip gap, and may in addition serve to break the tip vortex into several smaller vortices which may dissipate more quickly than a single vortex, thus causing less interaction with the following blade. After the blade has passed, the tip vortex can continue to induce flow along the shroud in the upstream direction, so the separation zones pictured can exist over a large circumferential extent. The presence of these separated zones may reduce the noise radiated by the shroud due to the unsteady pressure field. In regions between the blades where the tip vortex has moved downstream, the flow along the stepped surface moves in the downstream direction, and the separation zones shift to the axial surfaces, and vorticity of the opposite sign is generated.

Figure 9B:
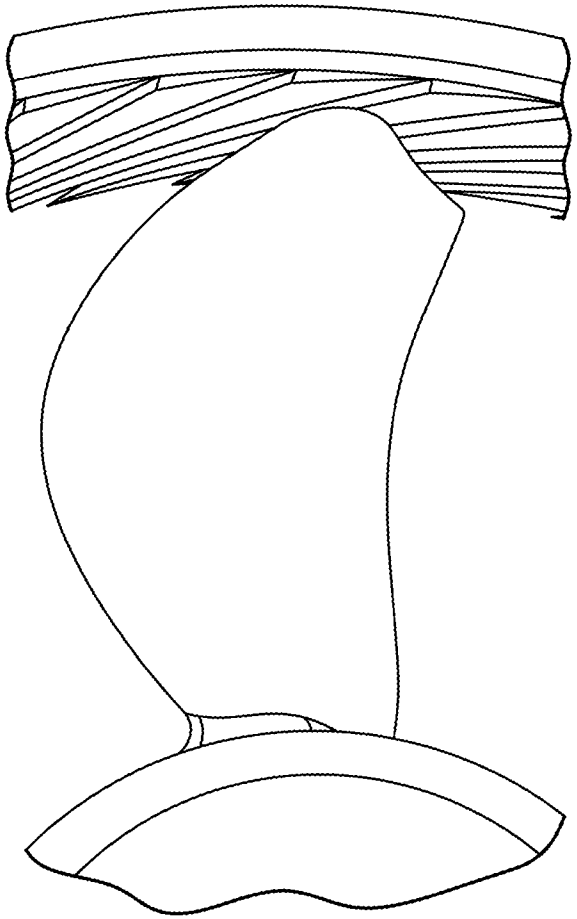
FIG. 9*b* is a perspective view of the free-tipped fan of FIG. 8 and a stepped barrel inlet where the steps are non-axisymmetric, and helically shaped.
Figure 9A:
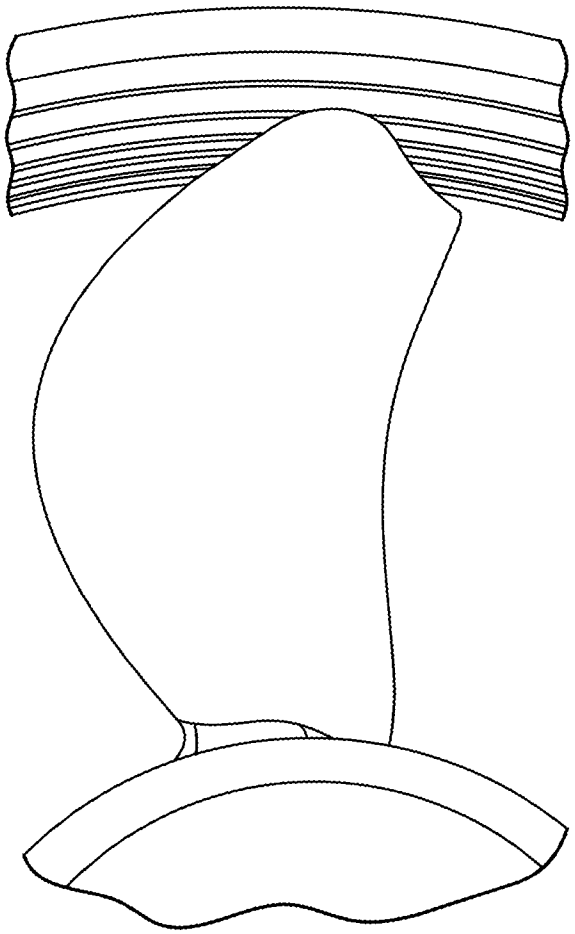
FIG. 9*a* is a perspective view of the free-tipped fan and the stepped barrel inlet of FIG. 8, where the steps are axisymmetric.

FIG. 9*a* is a perspective view of the free-tipped fan and the stepped barrel inlet of FIGS. 8*a*-8*c*, where the steps are axisymmetric. FIG. 9*b* is the same view of the free-tipped fan of FIGS. 8*a*-8*c* and a stepped barrel inlet where the steps are non-axisymmetric, and helically shaped. A meridional reaction through this shroud barrel 22 has a stepped profile very similar to that of FIG. 9*a*, but the axial position of the steps changes with circumferential position about the fan axis. Although the helically-shaped steps shown have an orientation opposite the blade pitch helix, other helically-shaped barrel steps can have an orientation similar to the blade pitch helix. Although a non-axisymmetric stepped barrel inlet can result in significant noise reduction compared to a smoothly flared inlet, it is not necessarily superior to an inlet with axisymmetric steps.

It should also be noted that any of the inlet geometries according to any of the constructions disclosed herein can be provided over the entire circumferential extent of the shroud (i.e., the complete 360-degree azimuthal angle range). However, in some cases, the inlet geometries described may be provided over less than the full circumferential extent. In such cases, the inlet geometry described may be present over a substantial portion of the circumferential extent (i.e., at least 33 percent). In some constructions, the geometry described may be present over at least a majority (i.e., greater than 180 degrees of azimuthal angle) of the circumferential extent and in some cases substantially more (e.g., 67 percent, 80 percent, 90 percent, 95 percent, or 99 percent).

Figure 10:
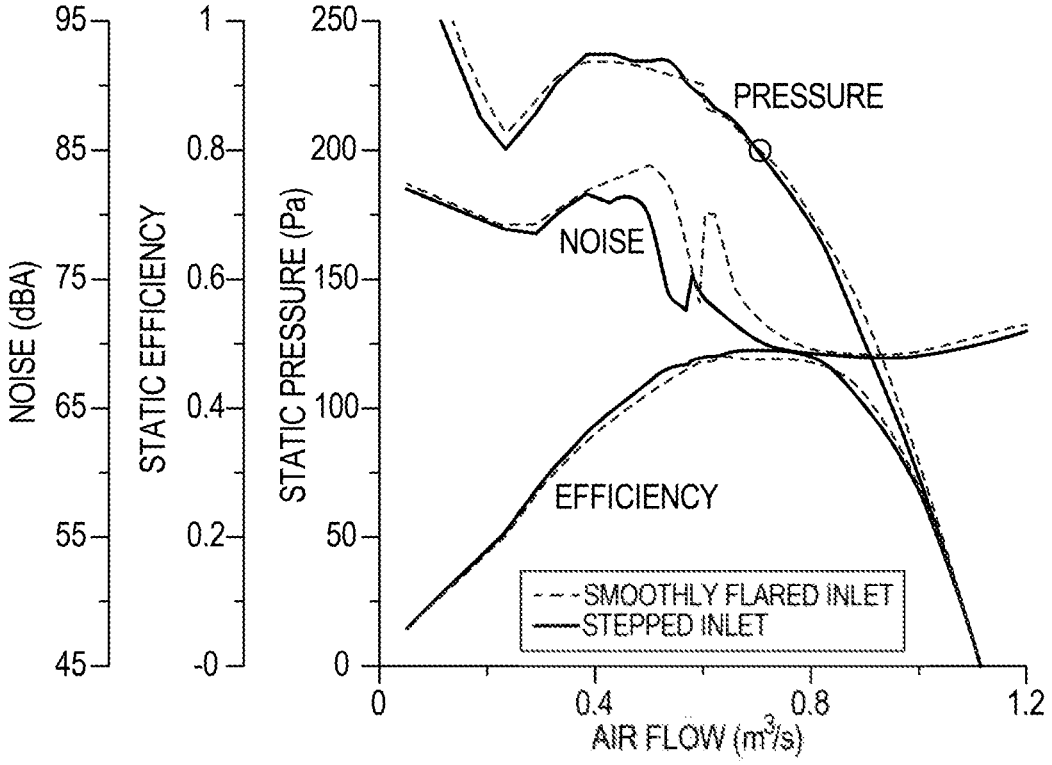
FIG. 10 is a plot of the performance of a fan assembly according to one embodiment of the present application compared to that of a prior-art tarn assembly which features a smoothly flared shroud barrel.

FIG. 10 shows the performance of a fan assembly according to one embodiment of the present application (solid line plots) compared to that of the prior-art fan assembly which differs only in that the inlet to the shroud barrel is smoothly flared (dashed line plots). The fan diameter is 375 mm. The operating speed of both fans is adjusted to achieve a design flow of 0.7 $m^3/s$ at a pressure of 200 Pa, which represents the vehicle "idle" condition, where the car is stationary. The speed of the fan in the prior-art assembly is 2760 rpm, and that of the fan assembly according to the present application is 2736 rpm. At the design point, indicated by a small circle on the pressure curves, the fan assembly according to the present application is 2.0 dB quieter than the prior-art fan. Its efficiency is 1.2 points higher. At higher pressure operating points the noise reduction is significantly larger.

Figure 11:
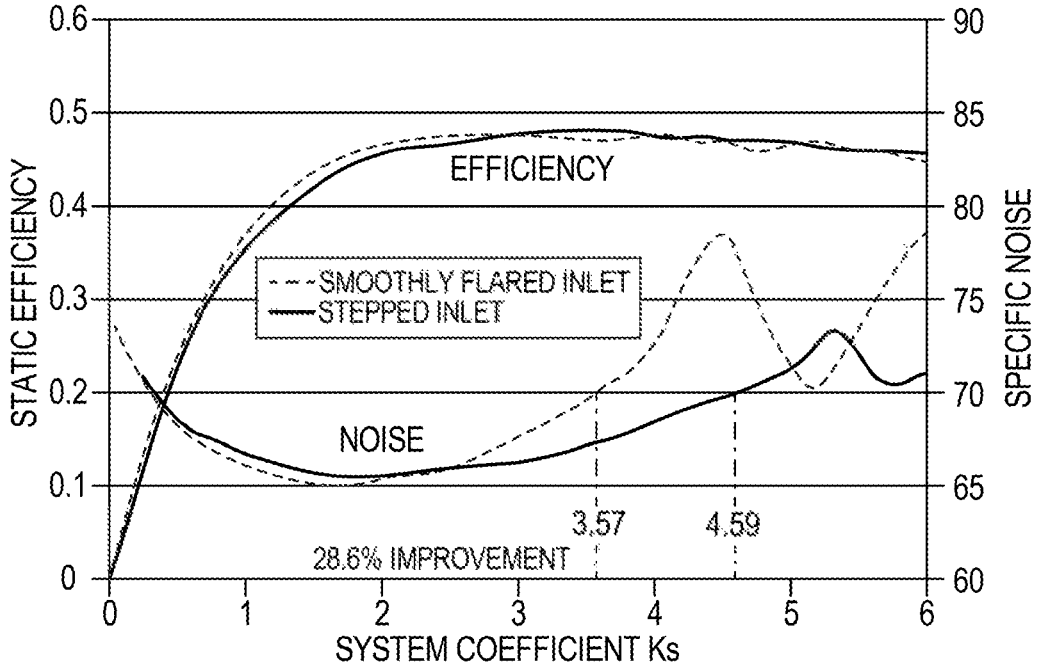
FIG. 11 shows the same data as that of FIG. 10, but using non-dimensional variables.

FIG. 11 shows the same data as that of FIG. 10, but in terms of different variables. Here the abscissa is the system resistance coefficient, proportional to the static pressure divided by the dynamic pressure. The right-hand ordinate is specific noise, which normalizes the measured noise considering the delivered air power and the fan disk area. The noise level of the baseline fan assembly increases dramatically between a system coefficient of 2.5 and 4.5. This can be referred to as the "noise wall". If one defines the position of the noise wall as the system coefficient where the specific noise exceeds 70 dB, the effect of the stepped inlet is to move the noise wall by 28.6 percent. This is a very significant increase. The stepped shroud allows a free-tip fan to be used in applications with significantly greater system resistance than is the case with a smoothly flared barrel inlet.

Figure 12A:
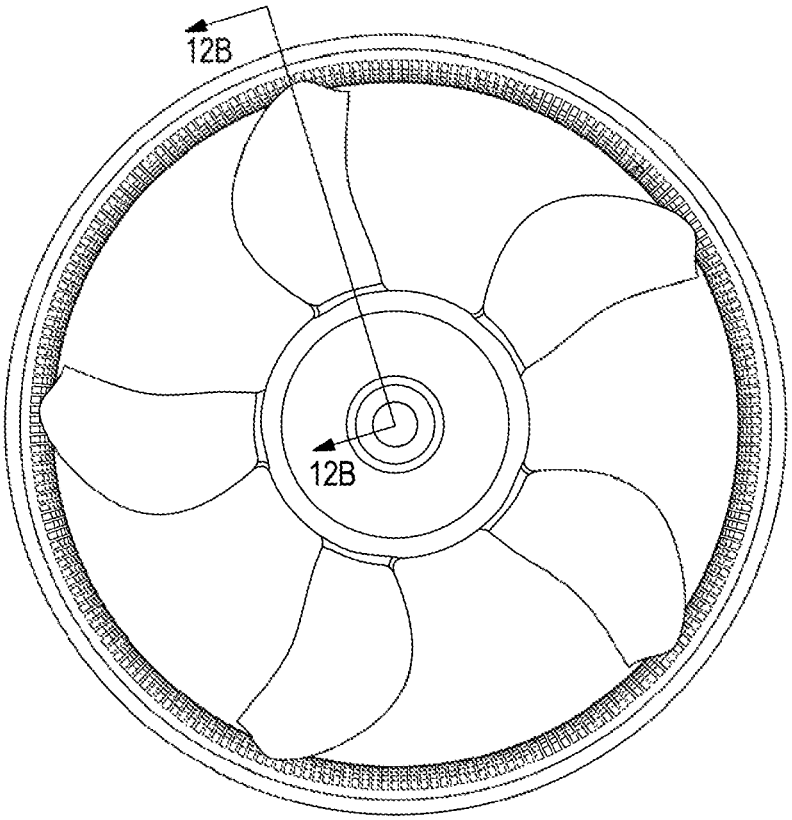
FIG. 12*a* is an axial view of the suction side of a fan according to U.S. Patent Application Pub. No. 2014/0271177 and a stepped barrel inlet, where the steps are discontinuous azimuthally.
Figure 12B:
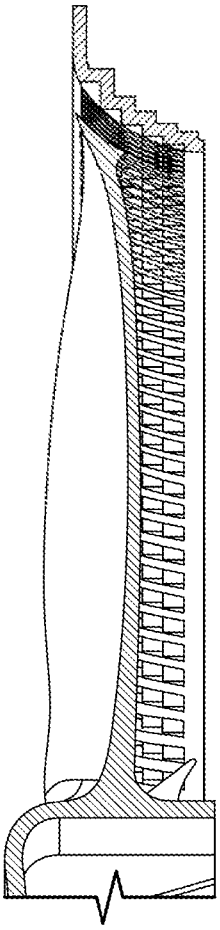
FIG. 12*b* is a meridional section, indicated in FIG. 12*a*, through the blade and barrel inlet at an angle corresponding to the point of maximum thickness at the blade tip, where that section passes through the shroud at an angle where the section is stepped.
Figure 12C:
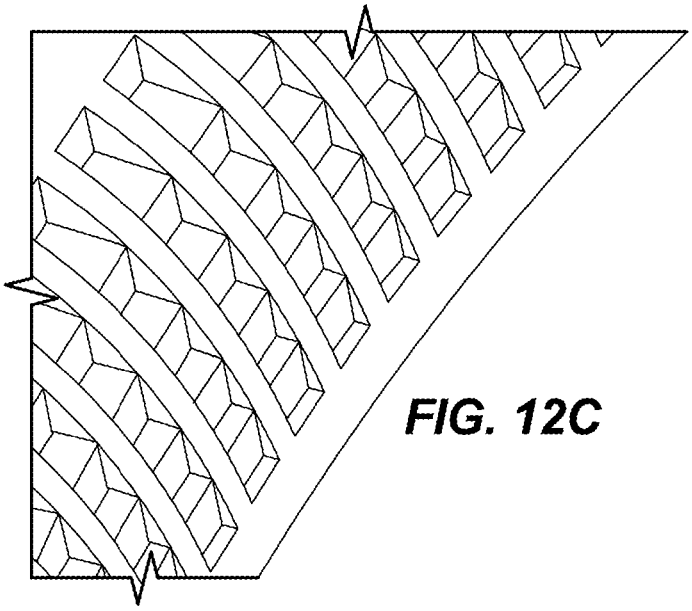
FIG. 12*c* is a perspective view of a portion of the shroud barrel inlet shown in FIG. 12*a*.

FIG. 12*a* is an axial view of the suction side of a fan according to U.S. Patent Application Pub. No. 2014/0271172 and a stepped barrel inlet where the steps are discontinuous azimuthally. Despite the stepped inlet shape being applied only over select azimuthal portions of the barrel inlet, there remain advantages similar to embodiments where the entire circumference of the shroud barrel inlet has the stepped shape. When the barrel inlet is only partially stepped, the stepped portion can be a single range of azimuthal angle, or, as in the case of FIG. 12*a*, multiple small ranges of azimuth. In sum, the portions having the stepped shape may form a majority azimuthal portion or region (i.e., greater than 180 degrees of azimuthal angle) of the inlet. FIG. 12*b* is a meridional section through the blade and barrel inlet at an angle corresponding to the point of maximum thickness at the blade as indicated in FIG. 12*a*, where this section passes through the shroud barrel inlet at a point where the section is shaped to include multiple steps. Each individual stepped portion is shown with a shape as shown in FIGS. 8*a* to 8*c* and as such, reference is made to the above description. However, in alternate constructions, the individual stepped portions can be shaped in accordance with any other construction as defined herein. FIG. 12*c* is a perspective view of a portion of the shroud barrel inlet.

Figure 13A:
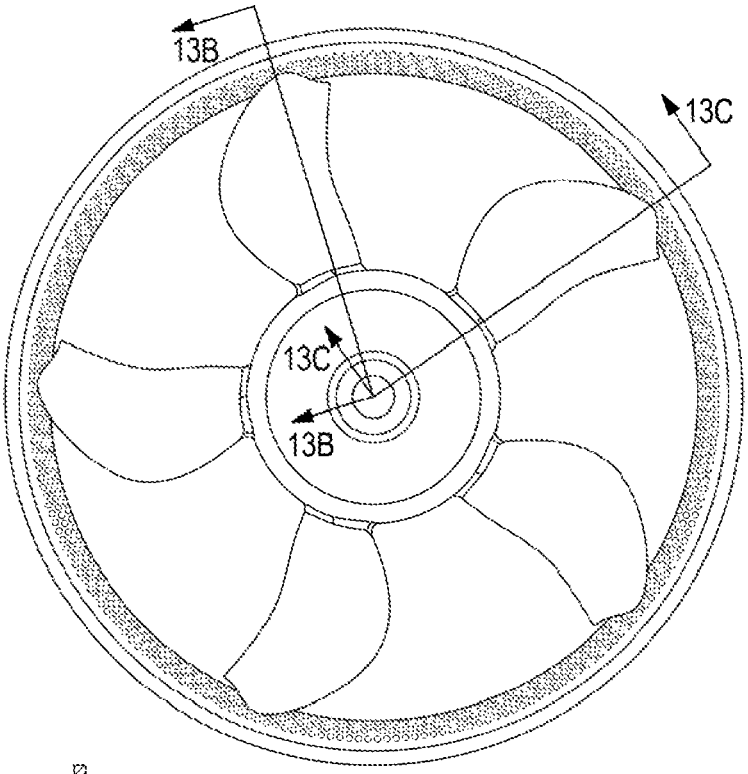
FIG. 13*b* is a meridional section, indicated in FIG. 13*a*, through the blade and barrel inlet at an angle corresponding to the point of maximum thickness at the blade tip, where this section passes through two inlet pockets.
FIG. 13*c* is a meridional section through the blade and barrel inlet at an angle such that the section passes through one inlet pocket.
FIG. 13*d* is a perspective view of a portion of the shroud barrel inlet shown in FIG. 13*a*.
Figure 13B:
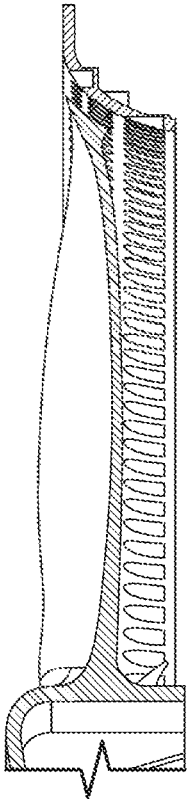
Figure 13C:
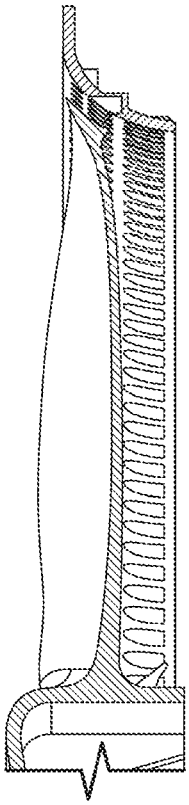
Figure 13D:
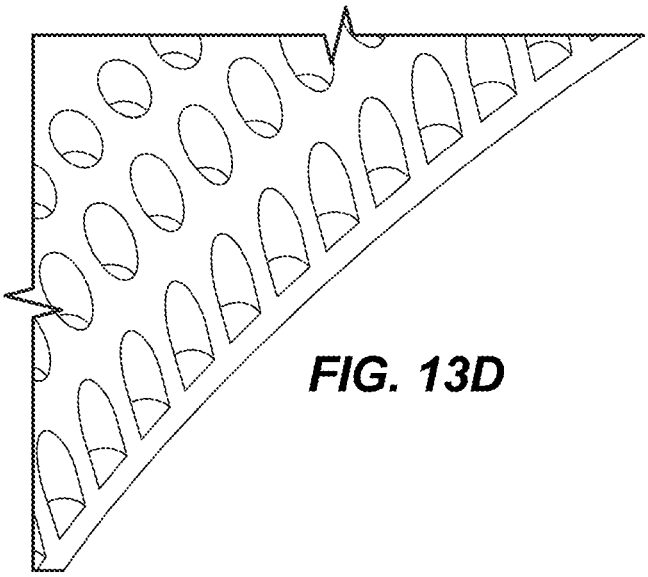

FIG. 13*a* is an axial view of the suction side of a fan according to U.S. Patent Application Pub. No. 2014/0271172 and a barrel inlet having staggered rows of pockets (e.g., circular pockets). Each of the pockets defines an axis that extends parallel to the fan axis, or has a majority component that is parallel to the fan axis. Whereas the shroud barrel inlet drown in FIG. 12*a* has azimuthally discontinuous steps, the barrel inlet of FIG. 13*a* can be considered to represent discontinuous axial grooves. This can be seen in FIGS. 13*b* and 13*c*. FIG. 13*b* is a meridional section through the blade and barrel inlet at an angle corresponding to the point of maximum thickness at the blade tip, as indicated in FIG. 13*a*, where this section passes through two pockets such that the inlet surface defines a region of non-monotonically varying angle "Θ" as described with reference to the earlier embodiments. This section resembles that of the axial grooves shown in FIG. 6*d*, although FIG. 6*d* includes an increased number of shaped features. FIG. 13*c* is a meridional section through the blade and barrel inlet at angle such that the section passes through a single pocket. While not required in all constructions, the portions at which multiple pockets are defined (in meridional cross-section) can, when taken in sum, make up a majority azimuthal portion or region (i.e., greater than 180 degrees of azimuthal angle) of the barrel inlet.

The contents of U.S. Pat. Nos. 6,595,744, 8,137,070, 9,004,860, and U.S. Patent Application Publication No. 2014/0271172 are all incorporated by reference herein. U.S. Pat. No. 6,595,744 describes a rake distribution which can reduce the axial deflection of a skewed free-tip fan, and U.S. Pat. No. 8,137,070 discloses a skew distribution which reduces the radial deflection of a free-tip fan. Both of these features can reduce the required design tip gap of a free-tip ran assembly. U.S. Pat. No. 9,004,860 discloses a change in blade camber and blade angle which acts to counteract the effect of the tip gap on the blade tip loading. U.S. Patent Application Pub. No. 2014/0271172 discloses a fan with an increased blade thickness at the blade tip which reduces the adverse effect of the tip gap on noise and efficiency. Since many of the aspects of the present application do not involve any changes to blade geometry, a fan assembly can beneficially incorporate any combination of features disclosed in any of these documents incorporated by reference, in addition to features of the present application. Further, it will be understood that features of the present application may be used with additional free-tipped fan blade geometries of other known types.

Fan assemblies having properties according to one or more aspects of the present application can be forward-skewed, back skewed, radial, or of a mixed-skew design. Similarly, fan assemblies according to one or more aspects of the present application can have any number of blades, any distribution of blade angle, camber, chord, or rake, and may be of either a pusher or a puller configuration.

What is claimed is:

1. A free-tipped axial fan assembly comprising:

a fan comprising a plurality of radially extending blades rotatable about a fan axis, each of the plurality of blades having a blade tip, a leading edge, and a trailing edge, wherein the fan has a diameter D equal to two times a radial extent of the respective blade tips at the trailing edge; and a shroud comprising a barrel, the barrel comprising an inlet, a radial dimension of the inlet at an upstream end being greater than a radial dimension of the inlet at a downstream end, wherein a first angle, in a meridional plane, between a surface of the inlet and a direction of the fan axis varies non-monotonically, with respect to a surface coordinate which increases with respect to a distance along the surface of the inlet from the upstream end to the downstream end so as to define a region of non-monotonically varying angle within the inlet, wherein a first portion of the inlet is located such that the region of non-monotonically varying angle within the inlet is defined at a first position that is upstream from the leading edges of the respective blades at a radially-outermost upstream portion of the respective blades, a second portion of the inlet is located such that the region of non-monotonically varying angle within the inlet is defined at a second position that is downstream from the first position and directly radially-above the radially-outermost upstream portion of the respective blades, and such that a radial dimension of the first portion of the inlet is greater than a radial dimension of the second portion of the inlet, and a radial extent of the respective blade tips at the leading edge is greater than the radial extent of the respective blade tips at the trailing edge, and wherein revolution of the respective blade tips about the fan axis defines a swept extent of the blade tips, the swept extent of the blade tips extending between the leading and trailing edges of the respective blade tips, such that in order for the swept extent of the blade tips to be non-conforming to the region of non-monotonically varying angle within the inlet, a second angle, in the meridional plane, between the swept extent of the blade tips and the direction of the fan axis decreases monotonically throughout the swept extent of the blade tips with respect to a blade tip coordinate which follows the swept extent of the blade tips and which increases with respect to a distance along the respective blade tips from the leading edge to the trailing edge.

2. The free-tipped axial fan assembly of claim 1, wherein a clearance gap distance between the swept extent of the blade tips and a plurality of locally closest points lying in the region of non-monotonically varying angle within the inlet, measured perpendicular to the swept extent of the blade tips, varies by no more than approximately 30 percent along the respective blade tips from the leading edge to the trailing edge.

3. The free-tipped axial fan assembly of claim 1, wherein a clearance gap distance between the swept extent of the blade tips and a plurality of locally closest points lying in the region of non-monotonically varying angle within the inlet, measured perpendicular to the swept extent of the blade tips, varies by no more than approximately 20 percent along the respective blade tips from the leading edge to the trailing edge.

4. The free-tipped axial fan assembly of claim 1, wherein a clearance gap distance between the swept extent of the blade tips and the second portion of the inlet at a position between a pair of adjacent locally closest points lying in the region of non-monotonically varying angle within the inlet, measured perpendicular to the swept extent of the blade tips, is at least 20 percent greater than an average value of the clearance gap distance at the pair of adjacent locally closest points.

5. The free-tipped axial fan assembly of claim 1, wherein a clearance gap distance between the swept extent of the blade tips and the second portion of the inlet at a position between a pair of adjacent locally closest points lying in the region of non-monotonically varying angle within the inlet, measured perpendicular to the swept extent of the blade tips, is at least 40 percent greater than an average value of the clearance gap distance at the pair of adjacent locally closest points.

6. The free-tipped axial fan assembly of claim 1, wherein a minimum clearance gap distance between the swept extent of the blade tips at the radially-outermost upstream portion of the respective blades and a plurality of locally closest points lying in the region of non-monotonically varying angle within the second portion of the inlet, measured perpendicular to the swept extent of the blade tips, is greater than 0.005 times the fan diameter D and less than 0.02 times the fan diameter D.

7. The free-tipped axial fan assembly of claim 1, wherein the surface of the inlet is axisymmetric.

8. The free-tipped axial fan assembly of claim 1, wherein the shroud is a plastic, injection-molded part.

9. The free-tipped axial fan assembly of claim 1, wherein the shroud comprises brackets which facilitate mounting of the fan assembly to a heat exchanger positioned upstream of the fan assembly.

10. The fee-tipped axial fan assembly of claim 9, wherein the shroud comprises a plenum upstream of the barrel and wherein an area of the heat exchanger covering the plenum is at least 1.5 times a fan disk area defined as the area of a circle with a diameter equal to the fan diameter D.

11. The free-tipped axial fan assembly of claim 1, wherein the region of non-monotonically varying angle within the inlet is defined by a plurality of steps and/or a plurality of grooves, and wherein the plurality of steps and/or the plurality of grooves may be configured using different geometric shapes.

12. A free-tipped axial fan assembly comprising:

a fan comprising a plurality of radially extending blades rotatable about a fan axis, each of the plurality of blades having a blade tip, a leading edge, and a trailing edge, wherein the fan has a diameter D equal to two times a radial extent of the respective blade tips at the trailing edge; and a shroud comprising a barrel, the barrel comprising an inlet, a radial dimension of the inlet at an upstream end being greater than a radial dimension of the inlet at a downstream end, wherein an angle, in a meridional plane, between a surface of the inlet and a direction of the fan axis varies non-monotonically, with respect to a surface coordinate which increases with respect to a distance along the surface of the inlet from the upstream end to the downstream end so as to define a region of non-monotonically varying angle within the inlet, wherein a first portion of the inlet is located at an axial location of a first portion of the respective blade tips;

wherein a radial dimension of the inlet at an upstream end of the first portion of the inlet is greater than a radial dimension of the inlet at a downstream end of the first portion of the inlet;

wherein a radial extent of each of the blade tips at an upstream end of the first portion of the respective blade tips is greater than a radial extent of each of the blade tips at a downstream end of the first portion of the respective blade tips;

wherein the region of non-monotonically varying angle is at least partially located within the first portion of the inlet to define a second portion of the inlet, a second portion of the respective blade tips being defined at an axial location of the second portion of the inlet; and wherein revolution of the respective blade tips about the fan axis defines a swept extent of the blade tips, the swept extent of the blade tips extending between the leading and trailing edges of the respective blade tips, and wherein the swept extent of the second portion of the respective blade tips conforms to an envelope curve in the meridional plane, which passes through a plurality of points on the second portion of the inlet which are closest to the respective blade tips.

13. The free-tipped axial fan assembly of claim 12, wherein the envelope curve is smooth.

14. The free-tipped axial fan assembly of claim 12, wherein axial and radial coordinates of the envelope curve are each approximately given as values of a spline curve, the spline curve being determined by:

1) creating a girth coordinate which follows a piecewise linear curve whose vertices are the plurality of points on the second portion of the inlet which are locally closest to the swept extent of the blade tips, 2) generating cubic splines of the axial and radial coordinates with respect to the girth coordinate, with knots located at the vertices, and 3) evaluating the cubic splines at values of the girth coordinate that lie between the vertices.

15. The five-tipped axial fan assembly of claim 12, wherein a clearance gap distance between the swept extent of the second portion of the respective blade tips and the envelope curve, measured perpendicular to the envelope curve, varies by no more than approximately 30 percent along the swept extent of the second portion of the respective blade tips.

16. The free-tipped axial fan assembly of claim 12, wherein a clearance gap distance between the swept extent of the second portion of the respective blade tips and the envelope curve, measured perpendicular to the envelope curve, varies by no more than approximately 30 percent along the swept extent of the second portion of the respective blade tips.

17. The free-tipped axial fan assembly of claim 12, wherein a clearance gap distance between the swept extent of the second portion of the respective blade tips and the second portion of the inlet at a position between an adjacent pair of locally closest points, measured perpendicular to the swept extent of the blade tips is at least 20 percent greater than a local value of the clearance gap distance between the second portion of the respective blade tips and the envelope curve.

18. The free-tipped axial fan assembly of claim 12, wherein a clearance gap distance between the swept extent of the second portion of the respective blade tips and the second portion of the inlet at a position between an adjacent pair of locally closest points, measured perpendicular to the swept extent of the blade tips, is at least 40 percent greater than a local value of the clearance gap distance between the second portion of the respective blade tips and the envelope curve.

19. The tree tipped axial fan assembly of claim 12, wherein minimum clearance gap distance between the swept extent of the second portion of the respective blade tips and the envelope curve, measured perpendicular to the envelope curve, is greater than 0.005 times the fan diameter D and less than 0.02 times the fan diameter D.

20. The free-tipped axial fan assembly of claim 12, wherein the envelope curve, within the second portion of the inlet, passes through at least 3 points on the inlet which are locally the closest to the respective blade tips.

* * * * *